US006688313B2

(12) United States Patent
Wrenn et al.

(10) Patent No.: US 6,688,313 B2
(45) Date of Patent: Feb. 10, 2004

(54) ELECTRICAL SMOKING SYSTEM AND METHOD

(75) Inventors: Susan E. Wrenn, Chesterfield, VA (US); A. Clifton Lilly, Jr., Chesterfield, VA (US); Traci L. Franklin, Mechanicsville, VA (US); Patrick H. Hayes, Chester, VA (US); Mary Ellen Counts, Richmond, VA (US); William James Crowe, Chester, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/814,779

(22) Filed: Mar. 23, 2001

(65) Prior Publication Data

US 2002/0005207 A1 Jan. 17, 2002

Related U.S. Application Data

(60) Provisional application No. 60/191,455, filed on Mar. 23, 2000, provisional application No. 60/191,460, filed on Mar. 23, 2000, and provisional application No. 60/191,461, filed on Mar. 23, 2000.

(51) Int. Cl.[7] ..... A24F 13/04
(52) U.S. Cl. ..... 131/194; 131/361; 131/360
(58) Field of Search ..... 131/194, 281, 131/360, 364, 344, 331, 361, 365

(56) References Cited

U.S. PATENT DOCUMENTS 3,496,945 A * 2/1970 Tomkin
3,637,447 A 1/1972 Berger et al.

(List continued on next page.)

OTHER PUBLICATIONS

Notification of Transmittal of International Preliminary Examination Report for PCT/US01/09302, dated Aug. 29, 2002.

Written Opinion dated Mar. 25, 2002 for International Application No. PCT/US01/09302.

*Primary Examiner*—Dionne A. Walls
(74) *Attorney, Agent, or Firm*—Burns, Doane, Swecker & Mathis, LLP

(57) ABSTRACT

An electrical smoking system comprising a cigarette and an electric lighter, wherein the cigarette comprises a tubular tobacco mat partially filled with material tobacco so as to define a filled tobacco rod portion and an unfilled tobacco rod portion. The cigarette and the lighter are mutually arranged so that when the cigarette is received in the lighter, the electrical heater element of the lighter at least partially superposes at least a portion of the filled tobacco rod portion. The cigarette and the lighter are also mutually arranged so that when the cigarette is received in the lighter, the free end of the cigarette is occluded. The cigarette includes a zone of perforations at a location along the filled tobacco rod portion, with the cigarette being free of perforations along the unfilled tobacco rod portion. An apparatus for perforating a cigarette which can be smoked in an electrical smoking device includes a drum link-up assembly and a laser perforating apparatus. The apparatus can be used in a method of perforating a tobacco rod of the cigarette prior to assembly of the tobacco rod to a filter rod via tipping paper. In the method, a tobacco rod is supplied to the drum link-up assembly wherein the tobacco rod is moved from a combining apparatus to a tipping apparatus which attaches the tobacco rod to a filter rod by tipping paper. In making the cigarettes with a tobacco rod and a filter rod, a combining apparatus forms a continuous tobacco rod which is cut into 2-up tobacco rods.

27 Claims, 16 Drawing Sheets

U.S. PATENT DOCUMENTS

| | | | |
|---|---|---|---|
| 5,060,671 | A | 10/1991 | Counts et al. |
| 5,144,962 | A | 9/1992 | Counts et al. |
| 5,372,148 | A | 12/1994 | McCafferty et al. |
| 5,388,594 | A | 2/1995 | Counts et al. |
| 5,498,855 | A | 3/1996 | Deevi et al. |
| 5,499,636 | A | 3/1996 | Baggett, Jr. et al. |
| 5,505,214 | A | 4/1996 | Collins et al. |
| 5,591,368 | A | 1/1997 | Fleischhauer et al. |
| 5,665,262 | A | 9/1997 | Hajaligol et al. |
| 5,666,976 | A | 9/1997 | Adams et al. |
| 5,692,291 | A | 12/1997 | Deevi et al. |
| 5,692,525 | A | 12/1997 | Counts et al. |
| 5,865,185 | A | 2/1999 | Collins et al. |
| 5,902,501 | A | 5/1999 | Nunnally et al. |
| 5,954,979 | A | 9/1999 | Counts et al. |
| 6,040,560 | A | 3/2000 | Fleischhauer et al. |

* cited by examiner

ELECTRICAL SMOKING SYSTEM AND METHOD

This application claims priority under 35 U.S.C. §119 to Provisional Application No. 60/191,455 filed in the U.S. on Mar. 23, 2000; Provisional Application No. 60/191,460 filed in the U.S. on Mar. 23, 2000; and Provisional Application No. 60/191,461 filed in the U.S. on Mar. 23, 2000; the entire contents of which are hereby incorporated by reference.

FIELD OF INVENTION

The present invention relates to electrical smoking systems and methods of increasing delivery in electrical smoking systems.

BACKGROUND OF INVENTION

Traditional cigarettes are consumed by lighting an end of a wrapped tobacco rod and drawing air predominately through the lit end by suction at a mouthpiece end of the cigarette. Traditional cigarettes deliver smoke as a result of combustion, during which a mass of tobacco is combusted at temperatures which often exceeds 800° C. during a puff. The heat of combustion releases various gaseous combustion products and distillates from the tobacco. As these gaseous products are drawn through the cigarette, they cool and condense to form a smoke containing the tastes and aromas associated with smoking. Traditional cigarettes produce sidestream smoke during smoldering between puffs. Once lit, they must be fully consumed or be discarded. Relighting a traditional cigarette is possible but is usually an unattractive proposition to a discerning smoker for subjective reasons (flavor, taste, odor).

In an electrical smoking system, it is desirable to deliver smoke in a manner that meets the smokers experiences with more traditional cigarettes, such as an immediacy response (smoke delivery occurring immediately upon draw), a desired level of delivery (which correlates with FTC tar level), together with a desired resistance to draw (RTD) and consistency from puff to puff and from cigarette to cigarette.

Commonly assigned U.S. Pat. Nos. 5,388,594 and 5,692,525 disclose electrical smoking systems and methods of manufacturing a cigarette, which patents are incorporated by reference. The former patent describes an electrical smoking system including a novel electrically powered lighter and a novel cigarette that cooperates with the lighter. The preferred embodiment of the lighter therein included a plurality of metallic serpentine heaters disposed in a configuration that slidingly receives a tobacco rod portion of the cigarette. The preferred embodiment of the cigarette therein comprised a tobacco-laden tubular carrier, a cigarette paper overwrapped about the tubular carrier, an arrangement of flow-through filter plugs at a mouthpiece end of the carrier and a filter plug at the free (distal) end of the carrier. The cigarette and the lighter were configured such that when the cigarette is inserted into the lighter and as individual heaters are actuated for each puff, localized charring occurs at spots about the cigarette in the locality where each heater was bearing against the cigarette (hereinafter referred to as a "heater footprint" or "char zones"). Once all the heaters had been actuated, the cigarette is discarded.

In the latter patent, the cigarette includes a tobacco plug and the cigarette and the heater fixture are mutually configured such that the heater footprints (char zones) at least partially overlap the tobacco plug as well as a hollow portion of the tobacco rod. Such arrangement provides an immediacy of response from the early initiation of pyrolysis at the void, together with inclusion of a fuller flavor contribution from the plug of tobacco(s).

It has been desirous to produce an electrical smoking system of the type described above that produces delivery levels of substantially greater than 3 milligrams tar (FTC). A greater segment of smokers prefer the higher levels of delivery from their more traditional cigarettes of choice. Obtaining such levels of delivery in electrical smoking systems has heretofore been a challenging proposition.

For example, the previously described electrical smoking systems are battery operated, so that the total energy expended per puff needs to be kept at acceptable levels. Too much power application in the heater elements during a puff can lead to burn-throughs and sometimes undesired degrees of combustion.

In systems such as taught in commonly assigned U.S. Pat. No. 5,692,525, in which heater footprints (char zones) at least partially overlap a hollow portion of the tobacco rod and partially overlap a tobacco plug, burn-throughs will usually first appear in the region of the hollow portion of the tobacco rod. Upon such occurrence, the smoke tends to be hotter than the other puffs, with less contribution of the fuller flavor usually generated by the heating of the tobacco plug portion of the cigarette rod. Consistency in the smoking experience are compromised if burn-throughs are not somehow avoided.

In commonly assigned U.S. Pat. No. 5,388,594, the smoked portion of the tobacco rod is preferably entirely hollow and the heater footprint is entirely superposed over a the hollow portion of the tobacco rod. Burn-throughs in the "wholly hollow" system of U.S. Pat. No. 5,388,594 tend to make the smoke all the more hot and/or harsh tasting. Providing expedients to increase delivery in the "wholly hollow" system of U.S. Pat. No. 5,388,594, such as providing perforations as suggested at column 10, lines 36–51 thereof, aggravate the risks of burn-throughs, with adverse consequences upon taste and consistency.

Resistance to draw (RTD) of traditional cigarettes is the pressure required to force air through the full length of a cigarette at the rate of 17.5 ml per second. RTD is usually expressed in inches or millimeter of water. Smokers have certain expectations when drawing upon a traditional cigarette in that too little RTD or too much can detract from smoking enjoyment. More traditional cigarettes of moderate delivery have RTD's generally within the range of approximately 100 to 130 mm water.

Establishing a desired RTD in electrical smoking systems is complicated by the circumstance that in smoking systems such as shown in U.S. Pat. Nos. 5,388,594 and 5,692,525, air is first drawn through passages within the cigarette lighter before being drawn out through the cigarette. The filter tipping of the cigarettes of those systems are preferably flow-through and/or low particulate efficiency filters so as to minimize loss of whatever smoke is produced. Such filters produce little pressure drop and therefore do not contribute much RTD. Consequently, prior practices have included the establishment of RTD (or pressure drop) predominantly in the lighter portion of the electrical smoking system, such as with an annular frit (porous body) adjacent the air admission port of the lighter as taught in commonly assigned U.S. Pat. No. 5,954,979. Because pressure drop varies widely with any change in size of the constriction, it has been found that the use of frits or other forms of tiny flow constrictions in the lighter body must be manufactured with care. It therefore adds expense and other production and quality concerns. Furthermore, tiny flow passages are prone to clog, particularly in lighters wherein any smoke is allowed to linger after completion of a puff.

OBJECTS AND SUMMARY OF INVENTION

An object of the present invention is to provide a cigarette containing cut filler or other form of shredded tobacco, which cigarette is adapted to cooperate with an electrical lighter and render satisfying levels of delivery and taste.

Another object of the present invention is to provide a cigarette for an electrical smoking system which includes cut filler, yet provides improved consistency in delivery from puff to puff.

Another object of the present invention is to provide a cigarette adapted for use in electrical smoking systems, which cigarette is resistive to breakage during the withdrawal of the cigarette from the lighter thereof.

It is still a further object of this invention to provide a novel cigarette that is operative with an electrical lighter and conducive to cost-effective methods of manufacture, even at production speeds.

These and other objects are achieved with the present invention which provides an electrical smoking system comprising a cigarette and an electric lighter, wherein the cigarette comprises a tubular tobacco mat partially filled with material tobacco so as to define a filled tobacco rod portion and an unfilled tobacco rod portion. The filled tobacco rod portion is situated adjacent a free end of said cigarette. The lighter comprises an electrical heater element and a system for electrically actuating said heater element, with the lighter being arranged to at least partially receive said cigarette. The cigarette and the lighter are mutually arranged so that when the cigarette is received in the lighter, the electrical heater element of the lighter at least partially superposes at least a portion of the filled tobacco rod portion. The cigarette and the lighter are also mutually arranged so that when the cigarette is received in the lighter, the free end of the cigarette is occluded. Furthermore, the cigarette includes a zone of perforations at a location along the filled tobacco rod portion, with the cigarette being free of perforations along the unfilled tobacco rod portion.

By such arrangements and others, the delivery (total particulate matter ("TPM") per FTC testing methodology) of the electrical smoking system may be increased without producing a hot, harsh-tasting smoke. Importantly, the enhanced delivery is achieved without overdriving the heater element of the lighter. The elevated delivery is achieved without additional load upon the batteries of the lighter and without driving the heater element to excessive peak temperatures.

A further aspect is provision of cooperative features within the lighter and the cigarette such that a large majority of the resistance to draw of the smoking system originates along the side walls of cigarette, with a lesser portion originating from flow passages within the lighter.

A further aspect of the present invention is provision of an air-flow deflector along an interior portion of the lighter to favorably direct air toward the cigarette.

In addition to the above, the invention provides an apparatus for perforating a tobacco rod prior to assembly of the tobacco rod to a filter rod via tipping paper, comprising a drum link-up assembly adapted to transfer a tobacco rod from a combining apparatus to a tipping apparatus wherein the tobacco rod is attached to a filter rod by tipping paper; and a laser perforating apparatus adapted to bum one or more holes in an outer surface of the tobacco rod while the tobacco rod is in the drum link-up assembly.

According to one embodiment of the invention, the laser perforating apparatus includes a lens arrangement which bums at least one circumferentially extending row of perforations around the tobacco rod. According to another embodiment, the drum link-up assembly includes a drum having flutes on an outer surface thereof, the laser perforating apparatus being adapted to rotate the tobacco rod about its axis while pulsing a laser to burn the at least one row of perforations into the tobacco rod as the tobacco rod is rolled from one flute to an adjacent flute. If desired, the laser perforating apparatus can include a beam splitter which separates a beam from a pulsed laser into at least two beams which bum at least two rows of elongated holes into the tobacco rod to form a laser perforated tobacco rod. Preferably, the drum link-up assembly comprises at least one rotating drum having flutes sized to carry 2-up tobacco rods.

According to a preferred embodiment, the drum link-up assembly includes a series of drums which transfer 2-up tobacco rods to the tipping machine, the drums including a catch drum, a transfer drum, a swash plate drum, a laser drum, a cutting drum, and a separating drum, the catch drum receiving 2-up tobacco rods from a delivery device of a combining apparatus and delivering the 2-up tobacco rods to the transfer drum, the transfer drum delivering the 2-up tobacco rods to the swash plate drum, the swash plate drum aligning the 2-up tobacco rods and delivering the aligned 2-up tobacco rods to the laser drum, the laser drum orienting the 2-up tobacco rods such that the laser perforating apparatus bums at least two longitudinally spaced apart rows of perforations on each of the 2-up tobacco rods, the laser drum delivering the 2-up tobacco rods to the cutting drum, the cutting drum cutting the 2-up tobacco rods into a pair of tobacco rods of unit length and delivering the pair of tobacco rods to the separating drum at which the pair of tobacco rods are spaced longitudinally apart, the separating drum delivering the tobacco rods to an assembly drum of a tipping apparatus at which the pair of tobacco rods are combined with a 2-up filter rod by placing the 2-up filter rod between the pair of spaced apart tobacco rods.

The apparatus can further comprise a combining machine which includes means for wrapping a tobacco plug and a free-flow filter plug within a tobacco matt and an outer paper wrapper to form a continuous tobacco rod, the combining machine including a cutting apparatus which cuts the continuous tobacco rod into 2-up tobacco rod segments, the laser perforating apparatus being adapted to burn perforating holes at locations on the 2-up tobacco rods such that the perforating holes pass through the outer paper wrapper and the tobacco matt and into the tobacco plugs of the 2-up tobacco rod segments. Further, the apparatus can include a tipping apparatus which includes means for attaching the perforated tobacco rods to filter rods by locating a 2-up filter rod in a space between a pair of the perforated tobacco rods, wrapping tipping paper around the 2-up filter rod such that the tipping paper overlaps portions of the perforated tobacco rods, gluing ends of the tipping paper together, and cutting the 2-up filter rods to produce a pair of cigarettes. If desired, the tipping apparatus can include a laser perforating station at which the cigarettes are provided with additional perforation holes, the laser perforating station including a lens arrangement which provides at least one circumferentially extending row of the additional perforations at a location along the tobacco rod.

The invention also provides a method of perforating a tobacco rod prior to assembly of the tobacco rod to a filter rod via tipping paper, comprising supplying a tobacco rod to a drum link-up assembly wherein the tobacco rod is moved from a combining apparatus to a tipping apparatus wherein the tobacco rod is attached to a filter rod by tipping paper, and forming a perforated tobacco rod by actuating a laser perforating apparatus so as to burn one or more perforating holes in an outer surface of the tobacco rod while the tobacco rod is in the drum link-up assembly.

Another object of the present invention is to establish a method of manufacturing with high speed production machinery a cigarette of the type operable with an electric lighter and containing cut filler.

It is another object of the present invention to provide a cigarette suited for consumption with a lighter of an electrical smoking system and a method of manufacturing same, wherein the cigarette is not subjected to forces which would tend to collapse or break the cigarette during its manufacture.

It is still a further object of this invention to provide a novel cigarette that is operative with an electrical lighter and a cost-effective method of manufacturing the cigarette.

These objects and other advantages are provided by the present invention which provides a cigarette operable with an electrically operated lighter, which lighter includes a plurality of electrical heaters, with each of the heaters being adapted to, either singularly or in concert, to generate tobacco smoke by applying heat to the cigarette along portions of the cigarette adjacent the heaters as a result of activation of the heater or heaters.

In accordance with one aspect of the present invention, the cigarette comprises a tubular tobacco web, wherein a first portion of the tubular tobacco web is filled with a column of tobacco, preferably in the form of cut filler, and a second portion of the tubular tobacco web is left unfilled or hollow so as to define a void in the tobacco column.

More particularly, the aforementioned cigarette preferably comprises a tobacco rod formed from a tubular tobacco web and a plug of tobacco located within the tubular tobacco web. The tobacco rod is adapted to be slidingly received by an electrical heater fixture such that the heater elements locate alongside the tobacco rod at a location between the free end and an opposite end of the tobacco rod. Preferably the plug (or column) of tobacco extends from the free end of the tobacco rod to a location that is spaced from the opposite end of the tobacco rod so as to define a void (or hollow portion) adjacent the opposite end.

Still another aspect of the present invention is to provide a filler containing cigarette that is operative with an electrical lighter, which cigarette includes a tobacco rod having a free-flow filter and a filler-free rod portion adjacent the free flow filter so as to promote consistent aerosol production.

A preferred embodiment of the present invention provides a method of manufacturing such cigarettes, wherein the method comprises the steps of establishing a succession of 2-up hollow plugs in alternating, spaced apart relation to 2-up tobacco plugs and wrapping the succession of plugs in a tobacco web and overwrap so as to produce a continuous rod; severing the resultant continuous rod to establish associated pairs of singular tobacco rod plugs; separating the members of each associated pair of singular tobacco rod plugs so as to establish a space therebetween; placing a 2-up filter tipping plug in the space between each a pair of separated, singular tobacco rod plugs; bringing the 2-up filter tipping plug and said singular tobacco rod plugs together into an abutting relation; and subsequently wrapping tipping paper about the placed 2-up filter tipping plug together with adjacent portions of the abutting singular tobacco rod plugs to form a 2-up cigarette rod; and severing the 2-up cigarette into individual cigarettes.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION OF THE PREFERRED EMBODIMENTS

Figure 1:
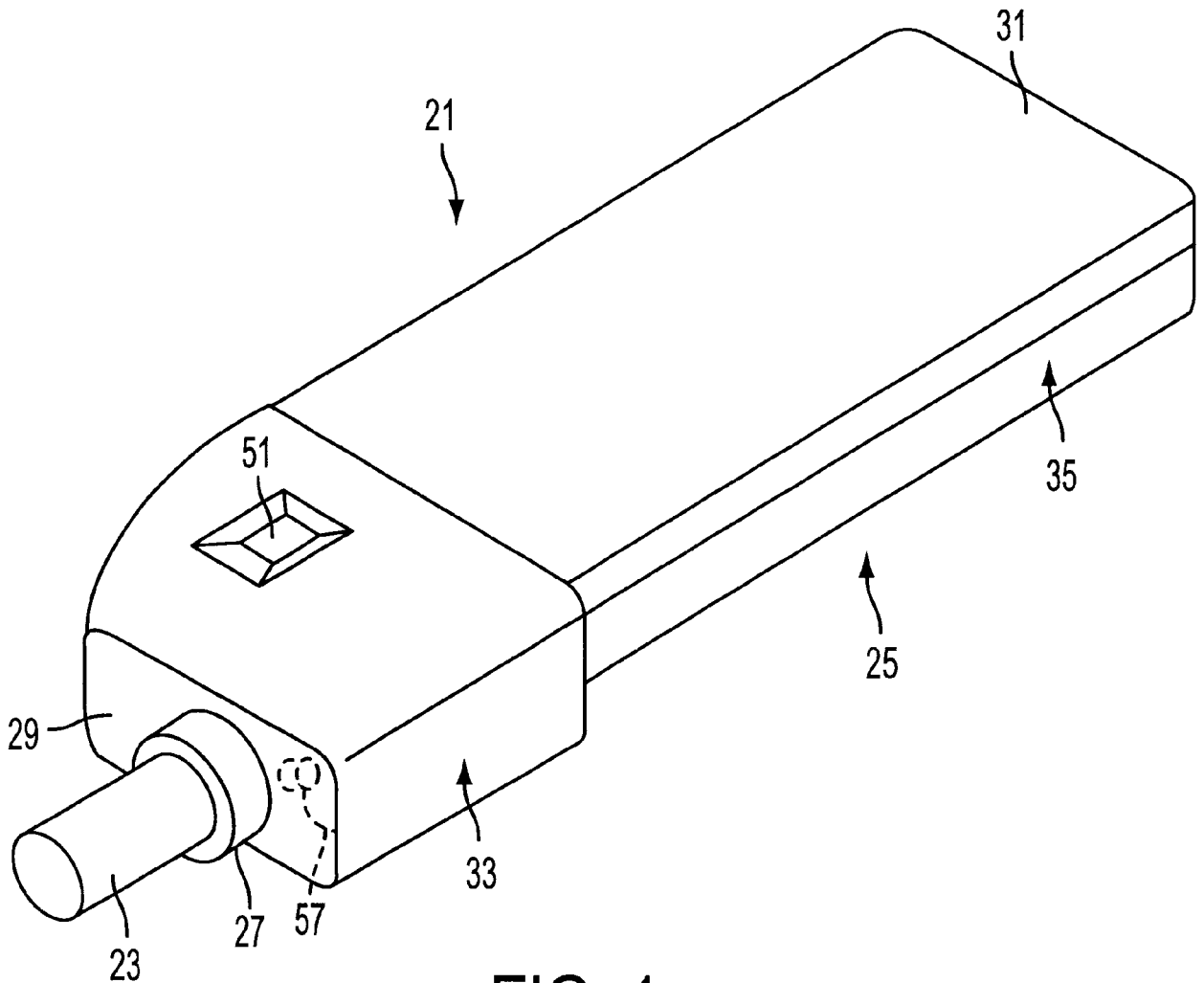
FIG. 1 is a perspective view of a smoking system in accordance with a preferred embodiment of the present invention with a cigarette of the system inserted into the electrically operated lighter.
Figure 2:
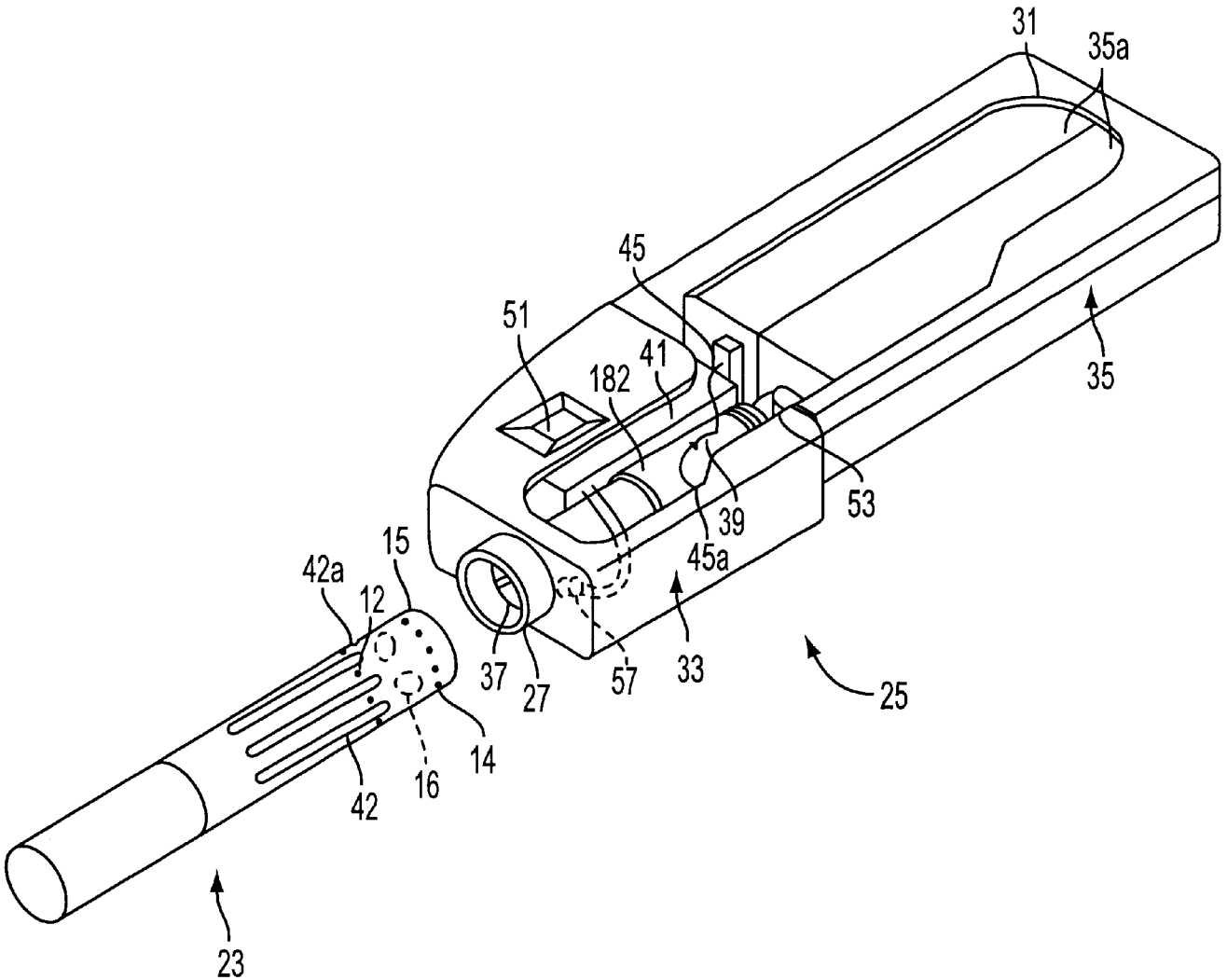
FIG. 2 is a perspective view of the smoking system of FIG. 1, but with the cigarette withdrawn from the lighter upon conclusion of a smoking.

Referring to FIGS. 1 and 2, a preferred embodiment of the present invention provides a smoking system 21 which preferably includes a partially-filled, filter cigarette 23 and a reusable lighter 25. The cigarette 23 is adapted to be inserted into and removed from a cigarette receiver 27 which is open at a front end portion 29 of the lighter 25. Once the cigarette 23 is inserted, the smoking system 21 is used in much the same fashion as a more traditional cigarette, but without lighting or smoldering of the cigarette 23. The cigarette 23 is discarded after one or more puff cycles. Preferably, each cigarette 23 provides a total of eight puffs (puff cycles) or more per smoke; however it is a matter of design expedient to adjust to a lesser or greater total number of available puffs. In the preferred embodiment, the cigarette 23 includes at least one peripheral ring of perforations 12 located adjacent the free end 15 of the cigarette 23 and optionally a second ring or rings of perforations 14 and optionally a plurality of holes 16 underneath the outer wrapper of the cigarette 23.

Further particulars of the smoking system is described also in the commonly assigned, U.S. Pat. Nos. 5,388,594; 5,505,214; 5,591,368 and 5,499,636, all which are hereby incorporated by reference in their entireties.

The lighter 25 includes a housing 31 having front and rear housing portions 33 and 35. One or more batteries 35*a* are removably located within the rear housing portion 35 and supply energy to a heater fixture 39 which includes a plurality of electrically resistive, heating elements 37 (shown in FIGS. 3A–C). The heating elements 37 are arranged within the front housing portion 33 to slidingly receive the cigarette 23 along an intermediate portion of the cigarette receiver 27. A stop 183 located at the base 300 of the heater fixture 39 defines a terminus of the cigarette receiver 27.

A control circuit 41 in the front housing portion 33 selectively establishes electrical communication between the batteries 35*a* and one or more the heater elements 37 during execution of each puff cycle. The preferred embodiment of the present invention includes details concerning an air management system for effecting the admission and routing of air within the lighter, including aspects which are discussed in greater detail beginning with reference to FIG. 3C.

Still referring to FIGS. 1 and 2, preferably the rear portion 35 of the lighter housing 31 is adapted to be readily opened and closed, such as with screws or snap-fit components, so as to facilitate replacement of the batteries. If desired, an electrical socket or contacts may be provided for recharging the batteries in a charger supplied with house current or the like. Preferably, the front housing portion 33 is removably joined to the rear housing portion 35, such as with a dovetail joint or a socket fit.

The batteries 35*a* are sized to provide sufficient power for the heaters 37 to function as intended and preferably comprise a replaceable and rechargeable type. Alternate sources of power are suitable, such as capacitors. In the preferred embodiment, the power source comprises four nickel-cadmium battery cells connected in series with a total, non-loaded voltage in the range of approximately 4.8 to 5.6 volts. The characteristics of the power source are, however, selected in view of the characteristics of other components in the smoking system 21, particularly the characteristics of the heating elements 37. Commonly assigned U.S. Pat. No. 5,144,962, hereby incorporated by reference, describes several types of power sources useful in connection with the smoking system of the present invention, such as rechargeable battery sources and power arrangements which comprise a battery and a capacitor which is recharged by the battery.

Referring specifically to FIG. 2, preferably, the circuitry 41 is activated by a puff-actuated sensor 45 that is sensitive to either changes in pressure or changes in rate of air flow that occur upon initiation of a draw on the cigarette 23 by a smoker. The puff-actuated sensor 45 is preferably located within the front housing portion 33 of the lighter 25 and is communicated with a space inside the heater fixture 39 adjacent the cigarette 23 via a port 45*a* extending through a side wall portion 182 of the heater fixture 39. A puff-actuated sensor 45 suitable for use in the smoking system 21 is described in commonly assigned U.S. Pat. No. 5,060,671 and U.S. Pat. No. 5,388,594, the disclosures of which are incorporated herein by reference. The puff sensor 45 preferably comprises Fujikura Ltd. Model FSS-02 PG. Another suitable sensor is a Model 163PCO1D35 silicon sensor, manufactured by the MicroSwitch division of Honeywell, Inc., Freeport, Ill. Flow sensing devices, such as those using hot-wire anemometry principles, have also been successfully demonstrated to be useful for actuating an appropriate one of the heater elements 37 upon detection of a change in air flow. Once actuated by the sensor 45, the control circuitry 41 directs electric current to an appropriate one of the heater elements 37.

An indicator 51 is provided at a location along the exterior of the lighter 25, preferably on the front housing portion 33, to indicate the number of puffs remaining in a smoke of a cigarette 23. The indicator 51 preferably includes a seven-segment liquid crystal display. In the preferred embodiment, the indicator 51 displays a segmented image which correlates with the digit "8" when a cigarette detector 57 detects the presence of a cigarette in the heater fixture 39. The detector 57 preferably comprises an inductive coil 1102 adjacent the cigarette receiver 27 of the heater fixture 39 and electric leads 1104 that communicate the coil 1102 with an oscillator circuit within the control circuitry 41. The cigarette 23 internally bears a foil ring or the like which can affect inductance of the coil winding 1102 such that whenever a cigarette 23 is inserted into the receiver 27, the detector 57 generates a signal to the circuitry 41 indicative of the cigarette being present. The control circuitry 41 in turn provides a signal to the indicator 51. The display of the digit "8" on the indicator 51 reflects that the eight puffs provided on each cigarette 23 are available, i.e., no puff cycle has been undertaken and none of the heater elements 37 have been activated to heat the cigarette 23. After the cigarette 23 is fully smoked, the indicator displays the digit "0". When the cigarette 23 is removed from the lighter 25, the cigarette detector 57 no longer detects a presence of a cigarette 23 and the indicator 51 is turned off.

The operation and details of the inductive cigarette detector 57 is provided in commonly assigned U.S. Pat. No. 5,902,501, which is incorporated herein by reference in its entirety. Other detectors may be employed instead of the above-described one for the detector 57, such as a Type OPR5005 Light Sensor, manufactured by OPTEX Technology, Inc., 1215 West Crosby Road, Carrollton, Tex. 75006.

In the alternative to displaying the remainder of the puff count, the detector display may instead be arranged to indicate whether the system is active or inactive ("on" or "off").

As one of several possible alternatives to using the above-noted cigarette detector 57, a mechanical switch (not shown) may be provided to detect the presence or absence of a cigarette 23 and a reset button (not shown) may be provided for resetting the circuitry 41 when a new cigarette is inserted into the lighter 25, e.g., to cause the indicator 51 to display the digit "8", etc. Power sources, circuitry, puff-actuated sensors, and indicators useful with the smoking system 21 of the present invention are described in commonly assigned, U.S. Pat. Nos. 5,060,671; 5,388,594 and 5,591,368, all which are incorporated herein by reference.

Figure 3A:
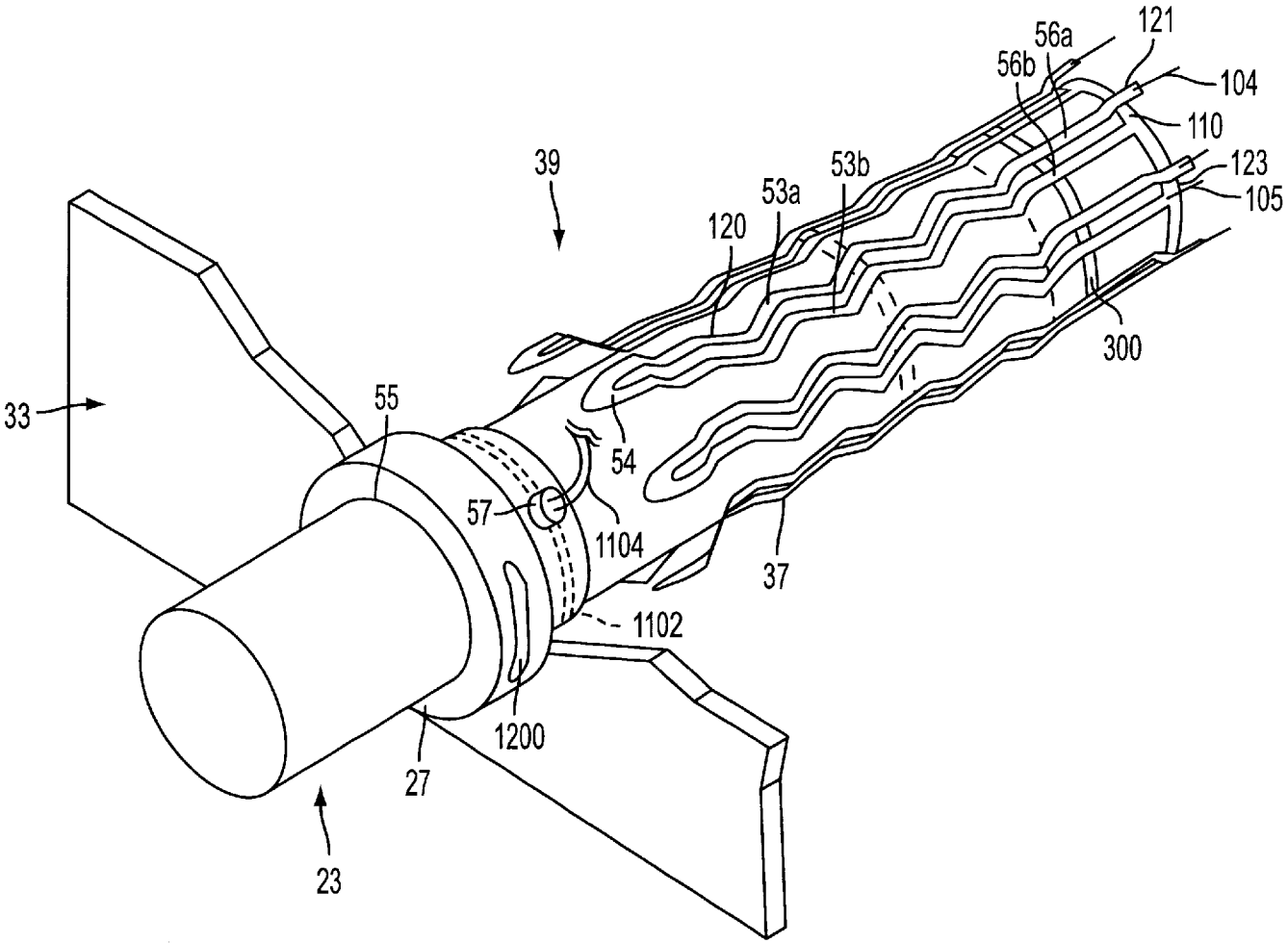
FIG. 3A is a partial perspective detail view of portions of the heater fixture of FIG. 1, including wavy hairpin heater elements and portions of a preferred air admission system.
Figure 3B:
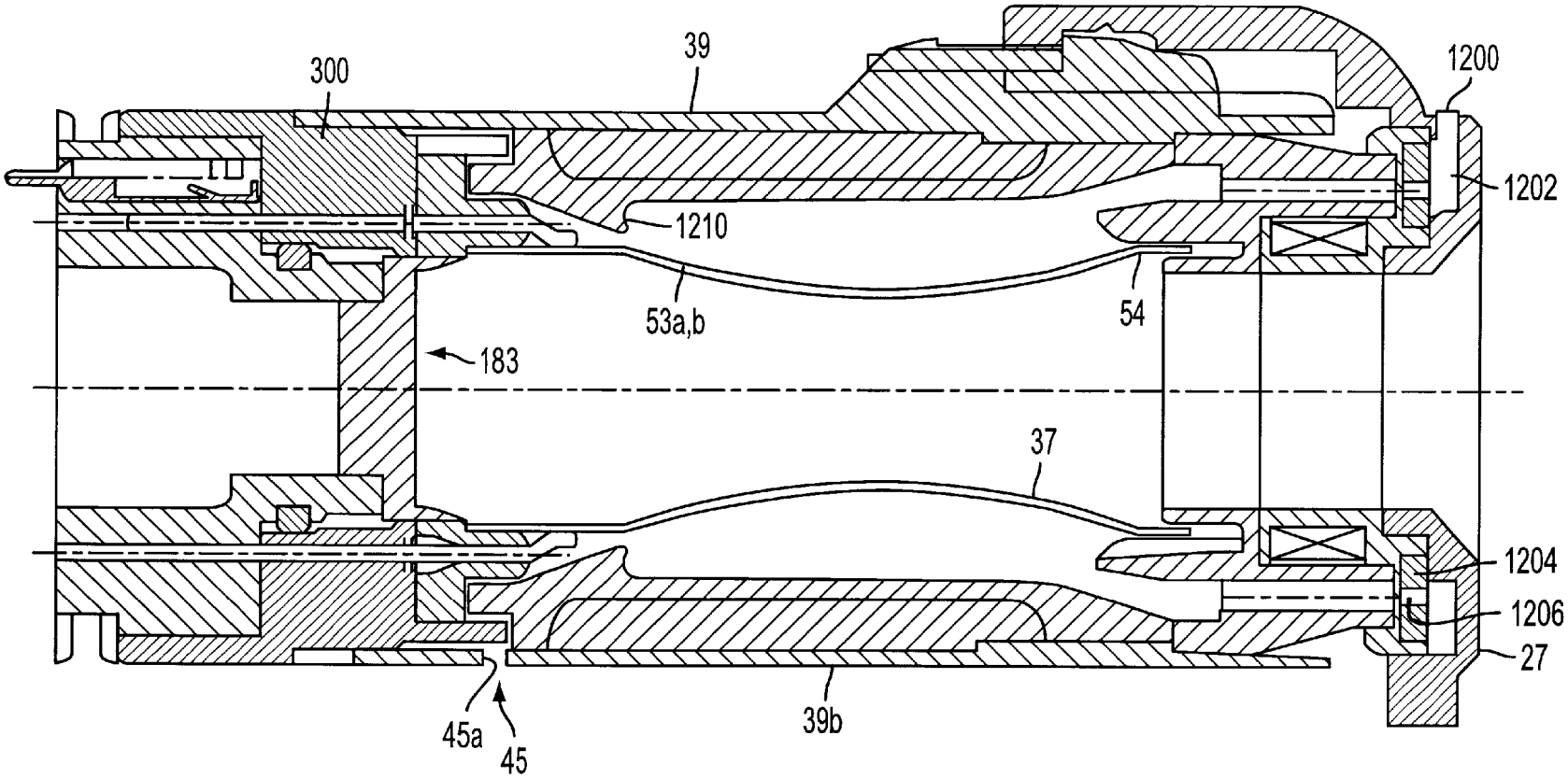
FIG. 3B is a sectional side view of a preferred heater fixture which includes the wavy hairpin heater elements of FIG. 3A.

Referring now to FIGS. 3A and 3B, the front housing portion 33 of the lighter 25 encloses a substantially cylindrical heater fixture 39 whose heater elements 37 slidingly receive the cigarette 23. The heater fixture 39 is adapted to support an inserted cigarette 23 in a fixed relation to the heater elements 37 such that the heater elements 37 are positioned alongside the cigarette 23 at approximately the same location along each newly inserted cigarette 23. In the preferred embodiment, the heater fixture 39 includes eight mutually parallel heater elements 37 which are disposed concentrically about the axis of symmetry of the cigarette receiver 27. The locations where each heater element 37 bears against (or is in thermal communication with) a fully inserted cigarette 23 is referred to herein as the heater footprint or char zone 42. In the preferred embodiment, the char zone may extend approximately 14 mm in length, beginning approximately 9 mm from the free-end 15 of the cigarette 23. Of course, these relations may be varied amongst different lighter and cigarette designs. In another model for example, the char zone 42 extends from 12 mm to 23 mm from the free-end of the cigarette 23.

Figure 3C:
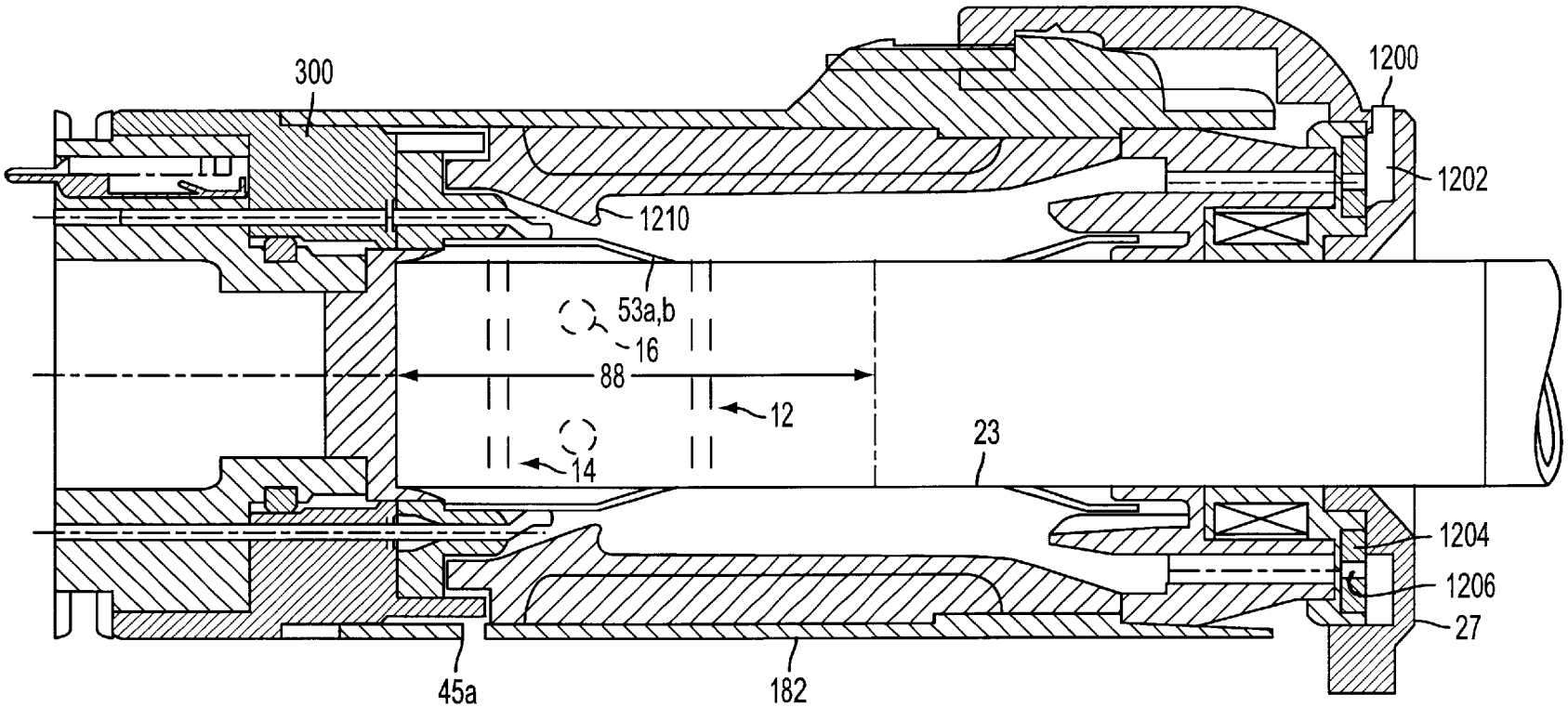
FIG. 3C is a side view of the cigarette shown in FIG. 4 inserted into the heater fixture of FIG. 6, with the latter being shown in cross-section.

Referring also to FIG. 3C, to assure consistent placement of the heating elements 37 relative to each cigarette 23 from cigarette to cigarette, the heater fixture 39 is provided with a base portion 300 having a cupped stop-piece 183 against which the free end 15 of the cigarette 23 is urged during its insertion into the cigarette receiver 27 of the lighter 25. The cupped shape of the stop-piece 183 is configured to close-off (occlude) the free end 15 of the cigarette 23 upon full insertion of the cigarette 23 so that air cannot be drawn through the free end 15, but instead only from along the side walls of the cigarette 23.

Still referring to FIGS. 3A and 3B, most preferably the heater elements 37 are of a design referred to herein as a wavy hairpin heater element 37, wherein each heater element 37 includes at least first and second serpentine, elongate members 53*a* and 53*b* which are adjoined at an end portion (tip) 54. The tips 54 are adjacent the opening 55 of the cigarette receiver 27. The opposite ends 56*a* and 56*b* of each heater element 37 are electrically connected to the opposite poles of the power source 35*a* as selectively established by the controller 41. More specifically, an electrical pathway through each heater fixture 37 is established, respectively, through a terminal pin 104, a connection 121 between the pin 104 and a free end portion 56*a* of one of the serpentine members 53*a*, through at least a portion of the tip 54 to the other serpentine member 53*b* and its end portion 56*b*. Preferably, an integrally formed, common connection ring 110 provides a common electrical connection amongst all the end portions 56*b* of the elongate member 53*b*. In the preferred embodiment, the ring 110 is connected to the positive terminal of the power source 35*a* (or common) through a connection 123 between the ring 110 and a pin 105. Further details of the construction and establishment of electrical connections in the heater fixture 39 are illustrated and described in the commonly assigned U.S. Pat. Nos. 5,060,671; 5,388,594 and 5,591,368, all which are incorporated herein by reference.

The heater portions 53*a*, 53*b* and 54 establish what is here referred to as a heater blade 120.

Other preferred designs of the heater fixture 39 include heater elements in the form of a straight hairpin heater elements 37, which are set forth in the commonly assigned U.S. Pat. No. 5,591,368 and "singular serpentine" heater elements each which are set forth in commonly assigned U.S. Pat. No. 5,388,594, said patents being incorporated herein by reference in their entireties.

Additional heater fixtures 37 that are operable as part of the lighter 25 include those disclosed in commonly assigned, U.S. Pat. No. 5,665,262; and commonly assigned, U.S. Pat. No. 5,498,855, all which are incorporated herein by reference in their entireties.

Preferably, the heaters 37 are individually energized by the power source 35*a* under the control of the circuitry 41 to heat the cigarette 23 preferably eight times at spaced locations about the periphery of the cigarette 23. The heating renders eight puffs from the cigarette 23, as is commonly achieved with the smoking of a more traditional cigarette. It may be preferred to activate more than one heater simultaneously for one or more or all of the puffs.

Figure 4:
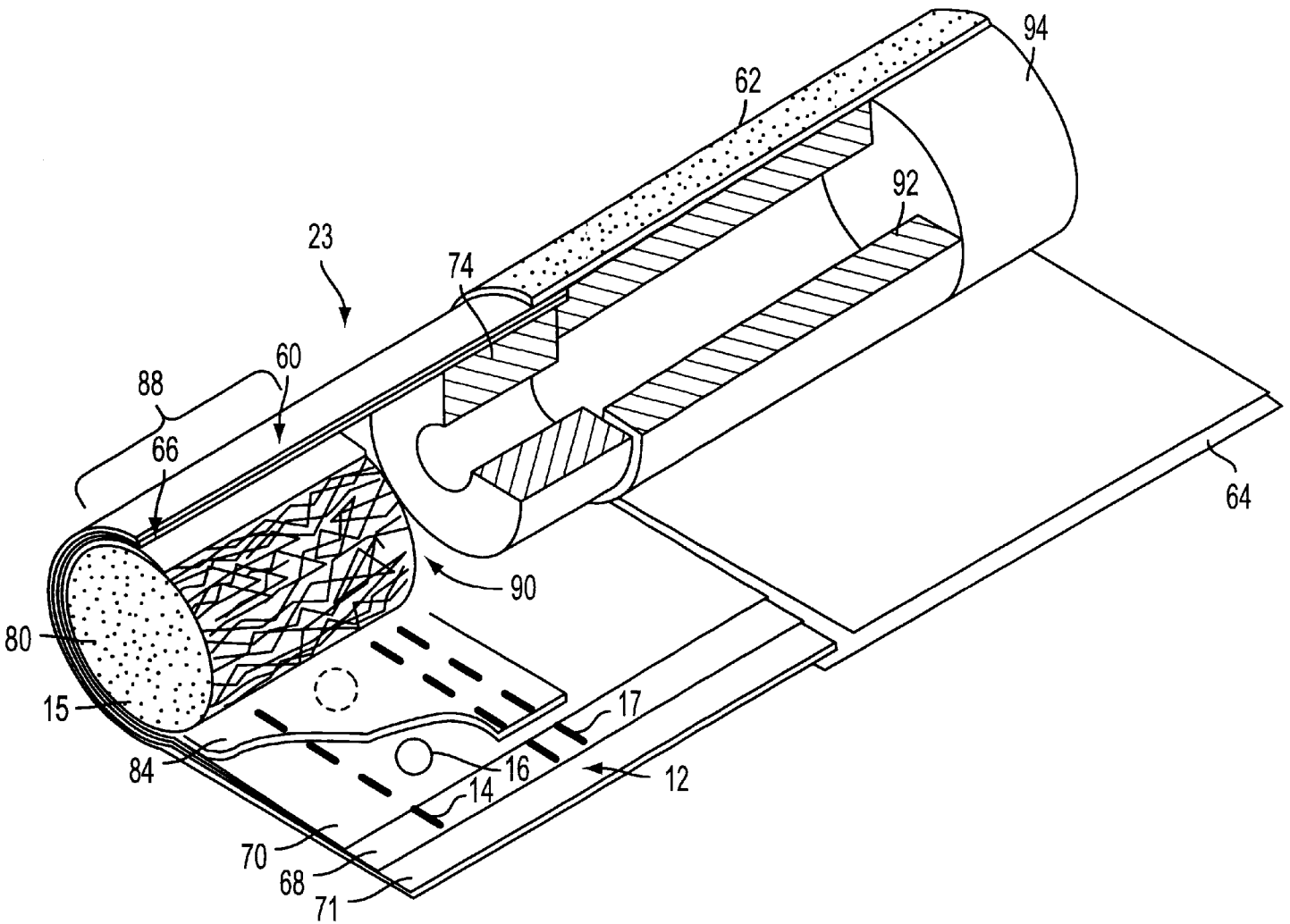
FIG. 4 is a detail perspective view of a preferred embodiment of the cigarette shown in FIG. 1, with certain components of the cigarette being partially unraveled.

Referring now to FIG. 4, the cigarette 23 is preferably constructed in accordance with the preferred embodiment set forth in commonly assigned, U.S. Pat. No. 5,499,636, herein incorporated by reference in its entirety.

Referring particularly to FIGS. 3A, 3B, and 3C, preferably the puff sensor 45 is communicated to the interior of the heater fixture 39 through a port 45*a*. Preferably, the port 45*a* is located adjacent the base portion 300 of the heater fixture 39. Such location minimizes the risk that the port 45*a* and adjacent passageways leading thereto through the body of the heater fixture 39 would become clogged by the debris or smoke condensates.

The heater fixture 39 includes an air inlet port 1200, which communicates with a manifold 1202 that is at least partially defined by a perforated annulus 1204 and the body of the receiver 27. The annulus 1204 includes preferably four holes 1206 of approximately 0.029 inch diameter for effecting a minimal pressure drop as air is drawn into the lighter through the air inlet port 1200 and the manifold 1202. The size and number of the holes 1206 may be varied, but such are configured to provide sufficient pressure drop that upon drawing action upon an inserted cigarette 23, a pressure drop is induced upon the air entering the lighter such that the puff sensor 45 is operative to recognize initiation of a puff. In the preferred embodiment, the holes 1206 of the annulus 1204 induce an RTD of approximately 25 mm water plus or minus 5 mm. The range of pressure drop induced at the annulus 1204 should be selected such that it is within the range of pressure drop detectable by the pressure sensor 45, but minimized to that need so that the remainder of desired RTD (Resistance To Draw) is effected predominantly by the cigarette 23. In the preferred embodiment, a grand total RTD of 4 to 5 inches water (100 to 130 mm water) is desired and approximately 25 mm of that is produced at the annulus 1204. Accordingly, the RTD of the cigarette 23 is preferably in the range of approximately 75 to 105 mm water RTD, when inserted in lighter 25 and the induced pressure drop of the lighter 25 is approximately 25 mm water. Adjustment of cigarette RTD in accordance with the present invention includes provision of and adjustment of the number and extent of perforations 12 (and optionally 14) in the filled portion 88 of the cigarette 23.

Advantageously, the holes 1206 of the annulus 1204, being located adjacent the receiver 27, is positioned away from sources of debris and condensates which might otherwise tend to clog the holes 1206.

Air that has been drawn into the lighter upon initiation of a puff enters alongside the cigarette with a substantial longitudinal (axial) velocity component toward the base portion 300 of the heater fixture 300. It has been discovered that a flow deflector or annular air-swoop 1210 adjacent the base portion 300 enhanced smoke output (delivery) of the system 21 by directing at least a portion of the entering airflow back toward the inserted cigarette 23. Not wishing to be bound by theory, it is believed that the air-swoop 1210 tends to direct airflow toward regions of the cigarette 23 bearing perforations 12. Preferably, the annular air-swoop 1210 is located relative to a fully inserted cigarette 23 such that the air-swoop 1210 circumscribes the general location along the cigarette 23 of the perforations 12.

It has discovered that the functioning of the air-swoop 1210 is improved if it is constructed from metal, or alternatively, all body portions of the heater fixture 39 are constructed from a metal such as a stainless steel, or at least those portions of the heater fixture 39 that are disposed adjacent an inserted cigarette 23. Such provision can provide an increase of delivery of 1 mg TPM (FTC).

The cigarette 23 comprises a tobacco rod 60 and a filter tipping 62, which are joined together with tipping paper 64.

The tobacco rod 60 of the cigarette 23 preferably includes a tobacco web or "mat" 66 which has been folded into a tubular (cylindrical) form about a free-flow filter 74 at one of its ends and a tobacco plug 80 at the other. In the alternative, a plug of cellulose acetate might be used in place of the tobacco plug 80. The longitudinal (axial) extent of the tobacco plug 80 defines a tobacco filled portion 88 of the partially-filled cigarette 23.

An overwrap 71 is intimately enwrapped about the tobacco web 66 and is held together along a longitudinal seam as is common in construction of more traditional cigarettes. The overwrap 71 retains the tobacco web 66 in a wrapped condition about a free-flow filter 74 and a tobacco plug 80.

The tobacco web 66 itself preferably comprises a base web 68 and a layer of tobacco material 70 located along the inside surface of the base web 68. At the tipped end of the tobacco rod 60, the tobacco web 66 together with the overwrap 71 are wrapped about the tubular free-flow filter plug 74. Preferably, the tobacco plug 80 is constructed separately from the tobacco web 66 and comprises a relatively short column of cut filler tobacco that preferably has been wrapped within and retained by a plug wrap 84.

As a general matter, the length of the tobacco plug 80 is preferably set relative to the total length of the tobacco rod 60 such that a void 90 is established along the tobacco rod 60 between the free-flow filter 74 and the tobacco plug 80. The void 90 corresponds to an unfilled portion of the tobacco rod 60 and is in immediate fluid communication with the tipping 62 through the free flow filter 74 of the tobacco rod 60.

The tipping 62 preferably comprises a free-flow filter 92 located adjacent the tobacco rod 60 and a mouthpiece filter plug 94 at the distal end of the tipping 62 from the tobacco rod 60. Preferably, the free-flow filter 92 is tubular and transmits air with very little pressure drop. Other low efficiency filters of standard configuration could be used instead, however. The inside diameter for the free flow filter 92 is preferably at or between 2 to 6 mm and is preferably greater than that of the free flow filter 74 of the tobacco rod 60.

The mouthpiece filter plug 94 closes off the free end of the tipping 62 for purposes of appearance and, if desired, to effect some filtration, although it is preferred that the mouthpiece filter plug 94 comprise a low efficiency filter of preferably about 15 to 25 percent efficiency.

Still referring to FIG. 4, preferably, the partially-filled cigarette 23 includes at least one row of perforations 12 at a location adjacent the free end 15 of the tobacco rod portion of the cigarette 23. Preferably, the row of perforations 12 are twelve holes in count and may be formed as slits 17 (perf-holes) at a 400 microsecond pulse width setting of a Hauni Model 500-1 on-line laser perforator system. Each perf-hole 17 of the row of perforations 12 preferably extends through the outer wrapper 71, through the tobacco mat 66 and the plug wrap 84.

Referring now also FIG. 2, preferably, the row of perforations 12 is located at or adjacent to end portion 42*a* of the char zone 42. Such placement is believed to promote entrance of heated air into the tobacco plug 80 and create other additional favorable effects upon pyrolysis during a puff cycle such that delivery (TPM-FTC) is enhanced.

To further improve delivery, additional row or rows of perforations 14 comprising perf holes 17 as previously described may be provided at a location along the filled portion 88 of the tobacco rod 60 preferably, at a location superposed, or at least partially superposed, by the heater char zone or footprint 42 and/or alternatively, adjacent the free end 15 of the cigarette 23. In the latter alternate embodiment, the second row of perforations 14 is established at approximately 4 mm from the free end 15 of the cigarette 23. Either or both of the perforation rows 12 or 14 may comprise a single row or a dual row of perf-holes 17.

The number and extent of perf-holes 17 are resolved in accordance with two countervailing considerations. The addition of rows of perforation 12, 14 as described above contributes to enhanced delivery of the cigarette 23. However, each additional row of perforations 12, 14 reduces RTD along the side walls of the cigarettes 23. Preferably, the grand total RTD of the electrical smoking system 21 should provide the smoker a resistance to draw approximately the same as that experience with traditional cigarettes of approximately 4 to 5 inches water (approximately 100–130 mm water) or thereabouts, 80–130 mm water.

It has been found that at a total energy input of 23.8 Joules to a heater element 37, a cigarette 23 bearing a dual row of perforations 12 at a location 12 mm from the free end 15 of the cigarette (dual rows of 12 holes each) can produce deliveries substantially greater than 3 milligrams TPM (FTC). Further deliveries may be obtained by addition of a second row or rows of perforations 14.

Figure 7:
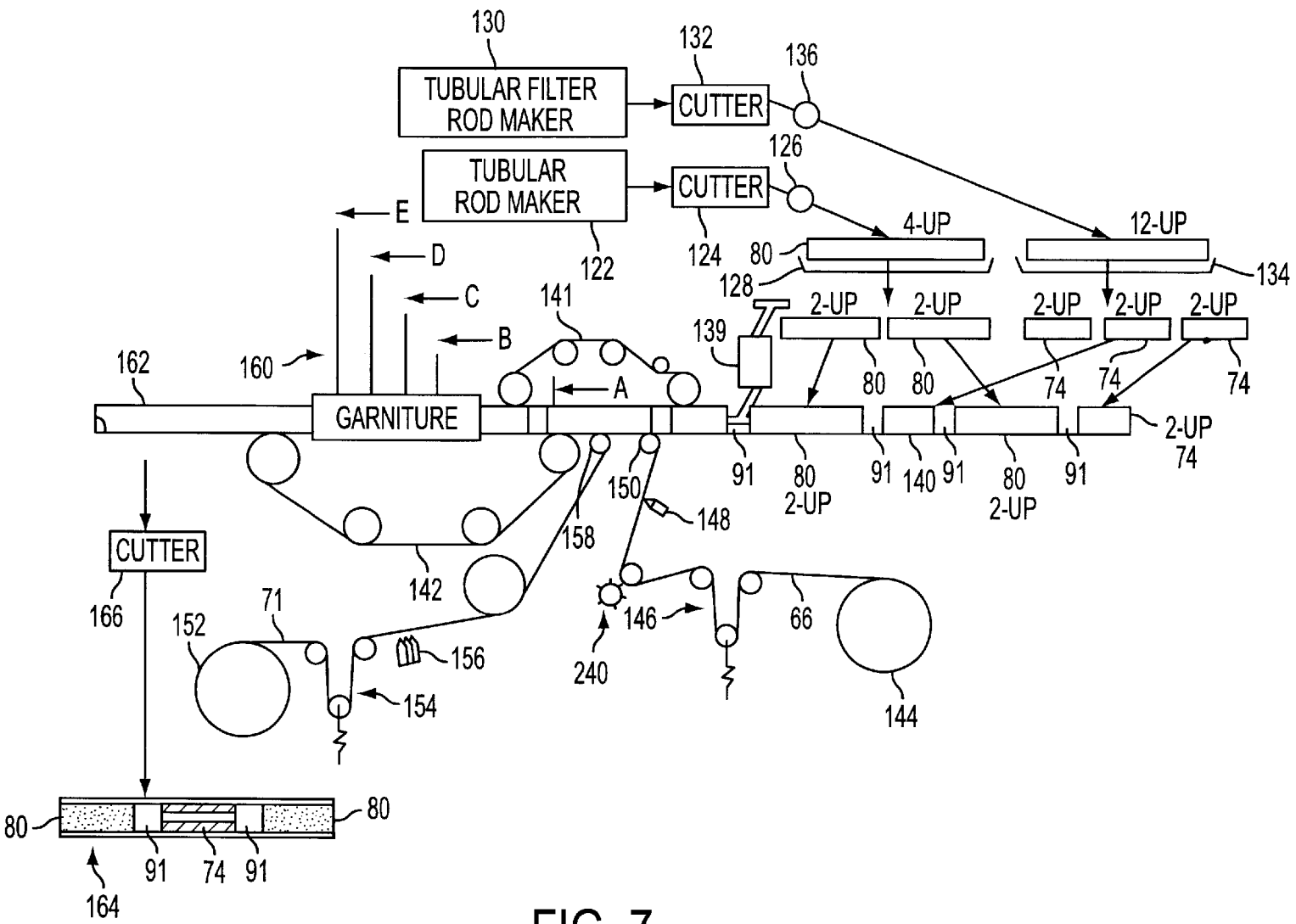
FIG. 7 is a representation of steps and apparatus in a preferred process of manufacturing tobacco rod portions of the cigarette shown in FIG. 4 in accordance with a preferred method of manufacturing such cigarettes.

However, each additional row of perf-holes 17 lowers RTD, which preferably is to remain at or above 100 mm water for the whole system 21. Should one find that for a given cigarette 23, additional delivery is desired yet the RTD level is nearing its lower limit, additional delivery can be obtained by provision of a plurality of circumferentially spaced-apart holes 16 placed in the mat 66 itself. Preferably, the mat holes 16 are each approximately one mm in diameter and preferably 6 in number so that the requisite tensile strength of the mat material 66 is maintained and may withstand machine manufacturing. Preferably, these holes are formed by an opposing punch-and-die roller assembly 240 as shown in FIG. 7 which is located along the feed-path of the mat in the cigarette making operation, as is described in U.S. Pat. No. 5,666,976, which patent is hereby incorporated by reference in its entirety.

For example, in the preferred embodiment, the mat holes 16 are preferably produced utilizing opposing rollers bearing hole-punching elements. Other devices may be employed instead, such as a disk or endless belt arrangement located along the feed path of the mat, with the disk or endless belt including multiple hole-punching dies which are brought to approximate feed speed of the mat by the movement of the disk or endless belt.

Preferably, the holes 16 in the mat 66 are covered by the outer wrapper 71. Preferably, any row of perforations 12, 14 is displaced away from the location of the row of mat holes 16 so that they do not overlap. In a preferred embodiment, the mat holes 16 are located approximately 7 mm from the free-end 15 of the cigarette 23, and a dual row of perforations 12 is established approximately 12 mm from the end 15 of the cigarette 23. So arranged, the cigarette achieves a 6 mg TPM (FTC) or more. Advantageously, the mat holes 16 can contribute an additional delivery to the cigarette 23 without the same extent of reduction in RTD as is experienced with each addition of row of perf-holes 17. Accordingly, one may utilize the rows of perforations 12, 14 to approximate desired delivery levels for the cigarette 23, with the mat holes 16 being used to adjust or increase delivery with a lesser effect on RTD.

More traditional cigarettes exhibit a resistance to draw (RTD) of approximately 80 mm to 130 mm water. The lighter of the electrical smoking system according to the present invention when tested without a cigarette exhibits an RTD of approximately 20–30 mm water. The cigarettes according to the present invention having the laser perforations and mat holes as taught herein exhibit an RTD of approximately 20–30 mm water when drawn upon by themselves (outside of the lighter of the electrical smoking system), but when inserted, the electrical smoking system (the lighter and the fully inserted cigarette) generate an RTD of approximately 50–75 mm water. Table 1 sets forth results of RTD measurements for cigarettes without perforations or mat holes, cigarettes with mat holes only and cigarettes with mat holes and a double row of laser perforations. The cigarettes had a circumference of 24 to 25 mm, the mat holes consisted of a single row of 6 mat holes 7 mm from the end of the cigarettes and the double row of perforations consisted of 12 holes in each row at a location about 12 mm from the end of the cigarette with the rows about 1 mm apart.

TABLE 1

| Run | Circumference (mm) | RTD-OE (mm) | RTD-BE (mm) |
|---|---|---|---|
| 1 | 24.58 | 32 | 875 |
| 2 | 24.53 | 35 | 551 |
| 3 | 24.57 | 30 | 57 |

- circumference and RTD values are average of results obtained for 25 cigarettes tested during each run
OE RTD of cigarettes tested in smoking machine with tobacco end of cigarettes open to atmosphere
BE RTD of cigarettes tested in smoking machine with tobacco end of cigarettes blocked by cup fitted over cigarette end In order to compare various aspects of cigarettes having various combinations of perf-holes 17 and mat holes 16 to cigarettes having no perforations or holes, test cigarettes having circumferences of 24 to 25 mm were constructed having the features set forth in Table 2.

The control cigarette had no perforations nor mat holes and test cigarettes 1–7 included laser perforations located 12 mm from the tobacco end of the cigarette and/or mat holes located 7 mm from the tobacco end of the cigarette.

The test cigarettes with laser perforations included either a single row of evenly spaced laser cut slits extending circumferentially around the cigarette or a double row of such laser perforations wherein the rows are located approximately 1 mm apart.

The test cigarettes with mat holes included a single row of six evenly spaced mat holes having diameters of 1 mm circumferentially spaced about the cigarette. As shown in the test results, the sample having a double row of 12 laser holes and the six 1 mm diameter mat holes provided tobacco smoke having the highest TPM. In the tests, the electrical smoking system was mounted in a conventional cigarette smoking machine that measures that portion of the smoke which is collected on a pad, its tar, nicotine and water. During the tests, the cigarette smoking machine was operated under FTC smoking conditions wherein a 2 second puff is taken every 60 seconds for a total of 8 puffs.

TABLE 2

| | Description | TPM, mg/cig. | Tar, mg/cig. | Nicotine, mg/cig | Water, mg/cig |
|---|---|---|---|---|---|
| | Control | 5.24 | 2.18 | 0.15 | 2.91 |
| 1 | single row of 6 laser perforations | 5.67 | 2.36 | 0.18 | 3.12 |
| 2 | single row of 12 laser perforations | 5.25 | 2.15 | 0.17 | 2.92 |
| 3 | double row of 6 laser perforations per row | 5.28 | 2.08 | 0.15 | 2.73 |
| 4 | double row of 12 laser perforations per row | 5.57 | 2.06 | 0.17 | 3.34 |
| 5 | single row of 6 laser perforations and 6 mat holes | 5.41 | 2.25 | 0.18 | 2.97 |
| 6 | double row of 12 laser perforations and 6 mat holes | 6.44 | 2.39 | 0.19 | 3.86 |
| 7 | 6 mat holes only | 5.56 | 2.07 | 0.16 | 3.33 |

Figure 5:
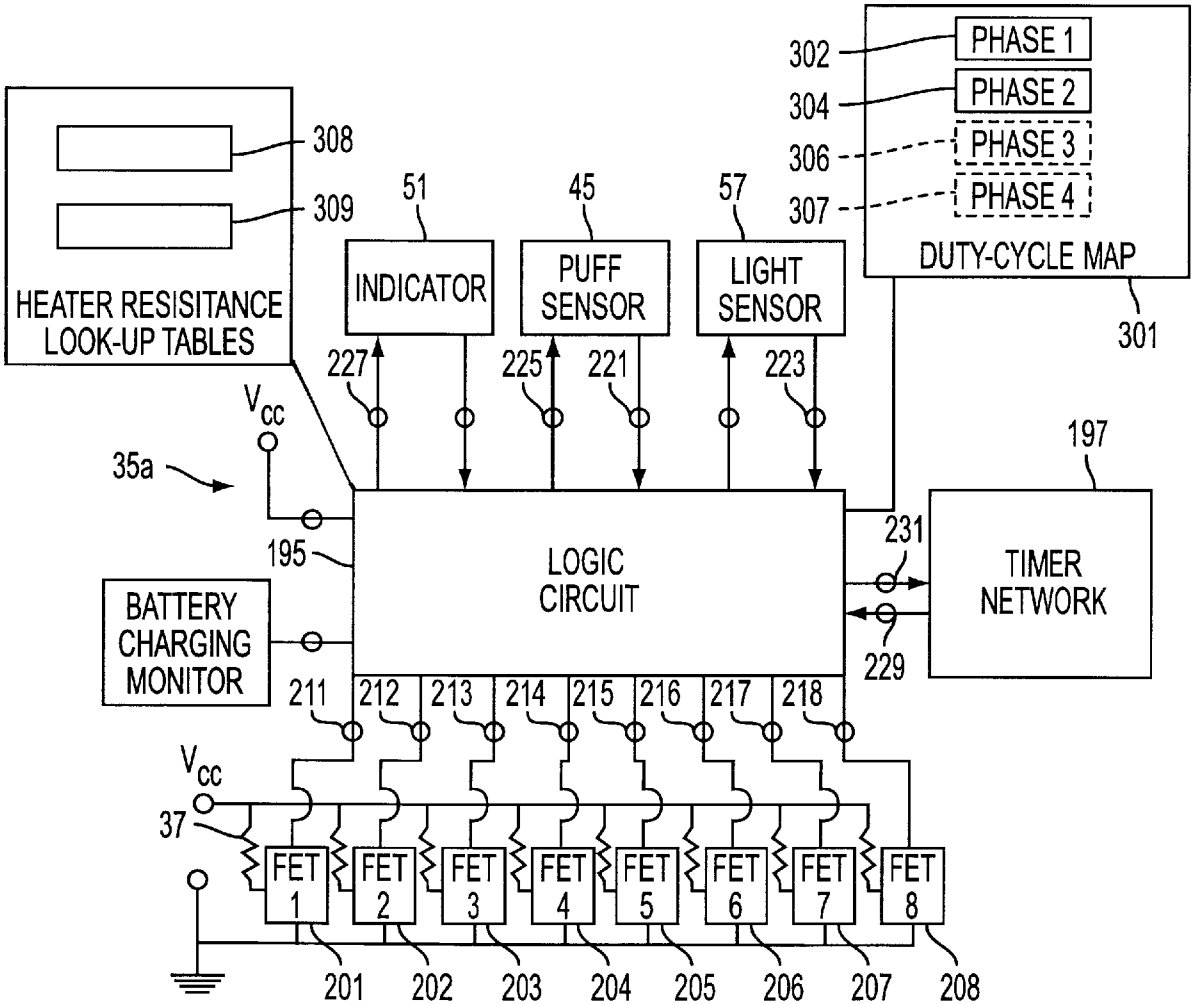
FIG. 5 is a schematic, block-diagram of a preferred control circuit for the lighter shown in FIGS. 1 and 2.

Referring now to FIGS. 2 and 5, the electrical control circuitry 41 of the lighter 25 includes a logic circuit 195, which preferably comprises a micro-controller or an application specific, integrated circuit (or "ASIC"). The control circuitry also includes the cigarette sensor 57 for detecting the insertion of a cigarette 23 in the cigarette receiver 27 of the lighter 25, the puff sensor 45 for detecting a draw upon the inserted cigarette 23, the LCD indicator 51 for indicating the number of puffs remaining on a cigarette, the power source 35*a* and a timing network 197.

The logic circuit 195 may comprise any conventional circuit capable of implementing the functions discussed herein. A field-programmable gate array (e.g., a type ACTEL A1280A FPGA PQFP 160, available from Actel Corporation, Sunnyvale, Calif.) or a micro controller can be programmed to perform the digital logic functions with analog functions performed by other components. An ASIC or micro-controller can perform both the analog and digital functions in one component. Features of control circuitry and logic circuitry similar to the control circuit 41 and logic circuit 195 of the present invention are disclosed, for example, in commonly assigned, U.S. Pat. Nos. 5,388,594; 5,505,214; 5,591,368; and 5,499,636, all which are hereby incorporated by reference in their entireties. Further details are also provided in the copending, commonly assigned U.S. Pat. No. 6,040,560, hereby incorporated by reference in its entirety.

In the preferred embodiment, eight individual heater elements 37 are connected to a positive terminal of the power source 35*a* and to ground through corresponding field effect transistor (FET) heater switches 201–208. Individual (or selected) ones of the heater switches 201–208 will turn on under control of the logic circuit 195 through terminals 211–218, respectively, during execution of a power cycle by the logic circuit 195. The logic circuit 195 provides signals for activating and deactivating particular ones of the heater switches 201–208 to activate and deactivate the corresponding heater element 37 of the heater fixture 39.

The logic circuit 195 cooperates with the timing circuit 197 to precisely execute the activation and deactivation of each heater element 37 in accordance with a predetermined total cycle period ("$T_{total}$") and to precisely divide each total cycle period into a predetermined number of phases, with each phase having its own predetermined period of time ("$t_{phase}$"). In the preferred embodiment, the total cycle period $T_{total}$ has been selected to be 1.6 seconds (so as to be less than the two-second duration normally associated with a smoker's draw upon a cigarette, plus provision for margin) and the total cycle period $T_{total}$ is divided preferably into two phases, a first phase having a predetermined time period ("$t_{phase\ 1}$") of 1.0 seconds and a second phase having a predetermined time period ("$t_{phase\ 2}$") of 0.6 seconds. The total cycle period $T_{total}$, the total number of phases and the respective phase periods are parameters, among others, that are resolved in accordance with the teachings which follow for establishing within the control circuit 41, a capacity to execute a power cycle that precisely duplicates a preferred thermal interaction ("thermal profile" or "thermo-histogram") between the respective heater element 37 and adjacent portions of the cigarette 23. Additionally, once the preferred thermo-histogram is established, certain parameters (preferably, duty cycles within each phase) are adjusted dynamically by the control circuit 41 so as to precisely duplicate the predetermined thermo-histogram with every power cycle throughout the range of voltages $v_{in}$ encompassed by the aforementioned battery discharge cycle.

The puff-actuated sensor 45 supplies a signal to the logic circuit 195 that is indicative of smoker activation (i.e., a continuous drop in pressure or air flow over a sufficiently sustained period of time). The logic circuit 195 includes a debouncing routine for distinguishing between minor air pressure variations and more sustained draws on the cigarette to avoid inadvertent activation of heater elements in response to errant signal from the puff-actuated sensor 45. The puff-actuated sensor 45 may include a piezoresistive pressure sensor or an optical flap sensor that is used to drive an operational amplifier, the output of which is in turn used to supply a logic signal to the logic circuit 195. Puff-actuated sensors suitable for use in connection with the smoking system include a Model 163PC01D35 silicon sensor, manufactured by the MicroSwitch division of Honeywell, Inc., Freeport, Ill., or a type NPH-5-02.5G NOVA sensor, available from Lucas-Nova, Fremont, Calif., or a type SLP004D sensor, available from SenSym Incorporated, Sunnyvale, Calif.

The cigarette sensor 57 is located at the cigarette receiver 27 and supplies a signal to the logic circuit 195 that is indicative of insertion of a cigarette 23 in the lighter 25. Optionally a second sensor may be located adjacent the stop 183 so as to determine whether the cigarette has been fully inserted into the receiver 27.

In order to conserve energy, it is preferred that the puff-actuated sensor 45 and the cigarette sensor 57 be cycled on and off at low duty cycles (e.g., from about a 2 to 10% duty cycle). For example, it is preferred that the puff actuated sensor 45 be turned on for a 1 millisecond duration every 10 milliseconds. If, for example, the puff actuated sensor 45 detects pressure drop or air flow indicative of a draw on a cigarette during four consecutive pulses (i.e., over a 40 millisecond period), the puff actuated sensor sends a signal through a terminal 221 to the logic circuit 195. The logic circuit 195 then sends a signal through an appropriate one of the terminals 211–218 to turn an appropriate one of the FET heater switches 201–208 ON.

Similarly, the cigarette sensor 57 is preferably turned on for a 1 millisecond duration every 10 milliseconds. If, for example, the cigarette sensor 57 detects four consecutive reflected pulses, indicating the presence of a cigarette 23 in the lighter 25, the light sensor sends a signal through terminal 223 to the logic circuit 195. The logic circuit 195 then sends a signal through terminal 225 to the puff-actuated sensor 45 to turn on the puff-actuated sensor. The logic circuit 195 also sends a signal through terminal 227 to the indicator 51 to turn it on. The above-noted modulation techniques reduce the time average current required by the puff actuated sensor 45 and the cigarette sensor 57, and thus extend the life of the power source 37.

The logic circuit 195 includes a PROM (programmable read-only memory) 301, which includes preferably at least two data bases or "look-up tables" 302 and 304, and optionally, a third data base (look-up table) 306 and possibly a fourth look-up table 307. Each of the look-up tables 302, 304 (and optionally 306, 307) converts a signal indicative of battery voltage $v_{in}$ to a signal indicative of the duty cycle ("$dc_1$" for the first phase and "$dc_2$" for the second phase) to be used in execution of the respective phase of the immediate power cycle. Third and fourth look-up tables 306 and 307 function similarly.

Upon initiation of a power cycle, the logic circuit receives a signal indicative of battery voltage $v_{in}$, and then references the immediate reading $v_{in}$ to the first look-up table 302 to establish a duty cycle $dc_1$ for the initiation of the first phase of the power cycle. The first phase is continued until the timing network 197 provides a signal indicating that the predetermined time period of the first phase ($t_{phase\ 1}$) has elapsed, whereupon the logic circuit 195 references $v_{in}$ and the second look-up table 304 and establishes a duty cycle $dc_2$ for the initiation the second phase. The second phase is continued until the timing network 197 provides a signal indicating that the predetermined time period of the second phase ($t_{phase\ 2}$) has elapsed, whereupon the timing network 197 provides a shut-off signal to the logic circuit 195 at the terminal 229. Optionally, the logic circuit 195 could initiate a third phase and establish a third duty cycle $dc_3$, and the shut-off signal would not be generated until the predetermined period of the third phase ($t_{phase\ 3}$) had elapsed. A similar regimen could optionally be established with a fourth phase ($t_{phase\ 4}$). The present invention could be practiced with additional phases as well.

Although the present invention can be practiced by limiting reference to the look-up tables to an initial portion of each phase to establish a duty cycle to be applied throughout the substantial entirety of each phase, a refinement and the preferred practice is to have the logic circuit 195 configured to continuously reference $v_{in}$ together with the respective look-up tables 302, 303, 306 and 307 so as to dynamically adjust the values set for duty cycles in response to fluctuations in battery voltage as the control circuit progresses through each phase. Such device provides a more precise repetition of the desired thermo-histogram.

Other timing network circuit configurations and logic circuits may also be used, such as those described in the commonly assigned, U.S. Pat. Nos. 5,388,594; 5,505,214; 5,591,368; 5,499,636; and 5,372,148, all which are hereby incorporated by reference in their entireties.

During operation, a cigarette 23 is inserted in the lighter 25 and the presence of the cigarette is detected by the cigarette sensor 57. The cigarette sensor 57 sends a signal to the logic circuit 195 through terminal 223. The logic circuit 195 ascertains whether the power source 35*a* is charged or whether the immediate voltage is below an acceptable minimum $v_{in\ min}$. If, after insertion of a cigarette 23 in the lighter 25, the logic circuit 195 detects that the voltage of the power source 35*a* is too low, below $v_{in\ min}$, the indicator 51 blinks and further operation of the lighter will be blocked until the power source 35*a* is recharged or replaced. Voltage of the power source 35*a* is also monitored during firing of the heater elements 37 and the firing of the heater elements 37 is interrupted if the voltage drops below a predetermined value.

If the power source 35*a* is charged and voltage is sufficient, the logic circuit 195 sends a signal through terminal 225 to the puff sensor 45 to determine whether a smoker is drawing on the cigarette 23. At the same time, the logic circuit 195 sends a signal through the terminal 227 to the indicator 51 so that the LCD will display the digit "8", reflecting that eight puffs are available.

When the logic circuit 195 receives a signal through terminal 221 from the puff-actuated sensor 45 that a sustained pressure drop or air flow has been detected, the logic circuit 195 sends a signal through terminal 231 to the timer network 197 to activate the timer network, which then begins to function phase by phase in the manner previously described. The logic circuit 195 also determines, by a downcount routine, which one of the eight heater elements is due to be heated and sends a signal through an appropriate terminal 211–218 to turn an appropriate one of the FET heater switches 201–208 ON. The appropriate heater stays on while the timer runs.

When the timing network 197 sends a signal through terminal 229 to the logic circuit 195 indicating that the timer has stopped running, the particular ON FET heater switch 211–218 is turned OFF, thereby removing power from the particular heater element 37. The logic circuit 195 also downcounts and sends a signal to the indicator 51 through terminal 227 so that the indicator will display that one less puff is remaining (e,g., "7", after the first puff). When the smoker next puffs on the cigarette 23, the logic circuit 195 will turn ON another predetermined one of the FET heater switches 211–218, thereby supplying power to another predetermined one of the heater elements. The process will be repeated until the indicator 51 displays "0", meaning that there are no more puffs remaining on the cigarette 23. When the cigarette 23 is removed from the lighter 25, the cigarette sensor 57 indicates that a cigarette is not present, and the logic circuit 195 is reset.

Other features, such as those described in U.S. Pat. Nos. 5,505,214; 5,388,594; and 5,372,148 which are incorporated by reference, may be incorporated in the control circuitry 41 instead of or in addition to the features described above. For example, if desired, various disabling features may be provided. One type of disabling feature includes timing circuitry (not shown) to prevent successive puffs from occurring too close together, so that the power source 35*a* has time to recover. Another disabling feature includes means for disabling the heater elements 37 if an unauthorized product is inserted in the heater fixture 39. For example, the cigarette 23 might be provided with an identifying characteristic that the lighter 25 must recognize before the heating elements 37 are energized.

Figure 6:
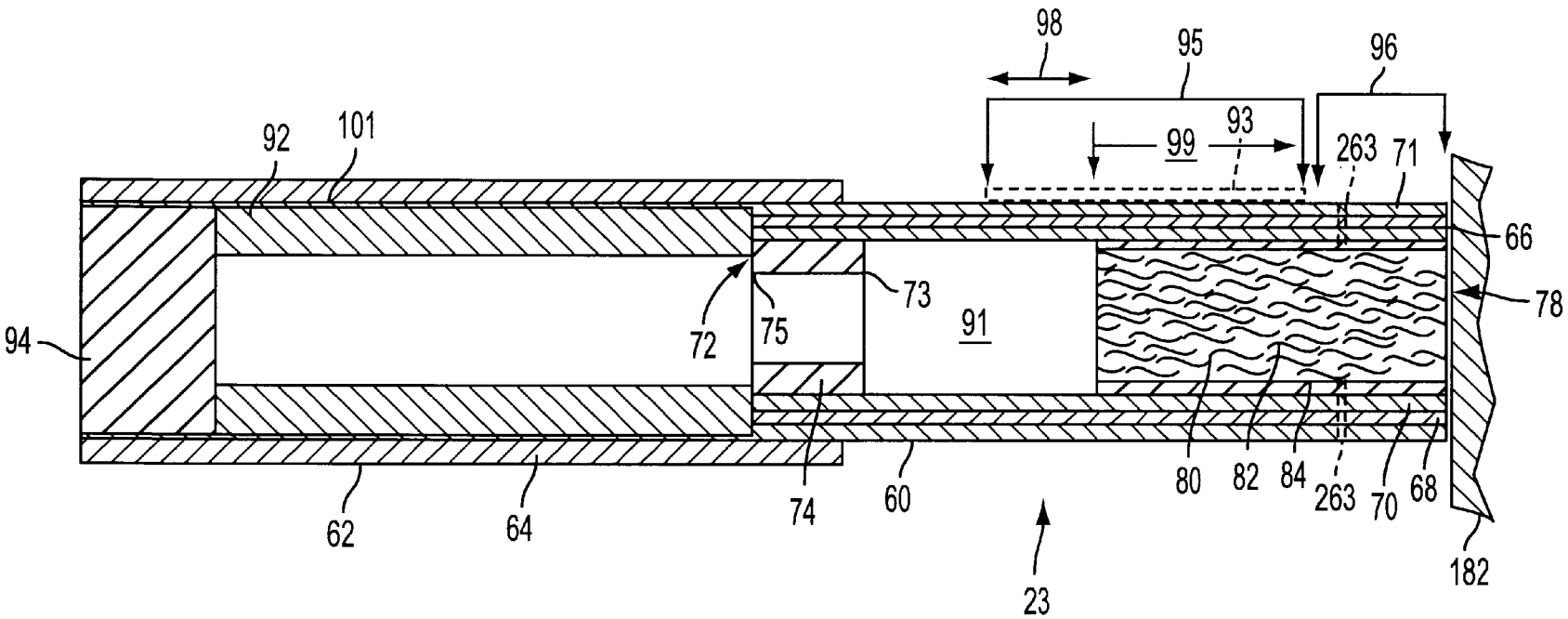
FIG. 6 is a side cross sectional view of the cigarette shown in FIG. 4 wherein a free end of the cigarette is in contact with a stop piece in the lighter.

Referring now to FIG. 6, the cigarette 23, as constructed in accordance with the preferred embodiment of the present invention, comprises a tobacco rod 60 and a filter tipping 62, which are joined together with tipping paper 64. During manufacture of the cigarette, perforation holes 263 can be provided in one or more locations in the outer surface of the tobacco rod 60.

The partially-filled, filler cigarette 23 preferably has an essentially constant diameter along its length and, which like more traditional cigarettes, is preferably between approximately 7.5 mm and 8.5 mm in diameter so that the smoking system 21 provides a smoker a familiar "mouth feel". In the preferred embodiment, the cigarette 23 is approximately 62 mm in overall length, thereby facilitating the use of conventional packaging machines in the packaging of the cigarettes 23. The combined length of the mouthpiece filter 94 and the free-flow filter 92 is preferably 30 mm. The tipping paper preferably extends approximately 6 mm over the tobacco rod 60. The total length of the tobacco rod 60 is preferably 32 mm. Other proportions, lengths and diameters may be selected instead of those recited above for the preferred embodiment.

The tobacco rod 60 of the cigarette 23 preferably includes a tobacco web or mat 66 which has been folded into a tubular (cylindrical) form.

An overwrap 71 intimately enwraps the tobacco web 66 and is held together along a longitudinal seam as is common in construction of more traditional cigarettes. The overwrap 71 retains the tobacco web 66 in a wrapped condition about a free-flow filter 74 and a tobacco plug 80.

Preferably, the cigarette overwrap paper 71 is wrapped intimately about the tobacco web 66 so as to render external appearance and feel of a more traditional cigarette. It has been found that a better tasting smoke is achieved when the overwrap paper 71 is a standard type of cigarette paper, preferably a flax paper of approximately 20 to 50 CORESTA (defined as the amount of air, measured in cubic centimeters, that passes through one square centimeter of material, e.g., a paper sheet, in one minute at a pressure drop of 1.0 kilopascal) and more preferably of about 30 to 45 CORESTA, a basis weight of approximately 23 to 35 grams per meter squared ($g/m^2$) and more preferably about 23 to 30 $g/m^2$, and a filler loading (preferably calcium carbonate) of approximately 23 to 35% by weight and more preferably 28 to 33% by weight. The overwrap paper 71 preferably contains little or no citrate or other burn modifiers, with preferred levels of citrate ranging from 0 to approximately 2.6% by weight of the overwrap paper 71 and more preferably less than 1%.

The tobacco web 66 itself preferably comprises a base web 68 and a layer of tobacco material 70 located along the inside surface of the base web 68. At the tipped end 72 of the tobacco rod 60, the tobacco web 66 together with the overwrap 71 are wrapped about the tubular free-flow filter plug 74. The free-flow filter 74 (also known in the art as "whistle-through" plugs) provides structural definition and support at the tipped end 72 of the tobacco rod 60 and permits aerosol to be withdrawn from the interior of the tobacco rod 60 with a minimum pressure drop. The free-flow filter 74 also acts as a flow constriction at the tipped end 72 of the tobacco rod 60, which is believed to help promote the formation of aerosol during a draw on the cigarette 23. The free-flow filter is preferably at least 7 millimeters long to facilitate machine handling and is preferably annular, although other shapes and types of low efficiency filters are suitable, including cylindrical filter plugs.

At the free end 78 of the tobacco rod 60, the tobacco web 66 together with the overwrap 71 are wrapped about a cylindrical tobacco plug 80. Preferably, the tobacco plug 80 is constructed separately from the tobacco web 66 and comprises a relatively short column of cut filler tobacco that has been wrapped within and retained by a plug wrap 84.

Preferably the tobacco plug 80 is constructed on a conventional cigarette rod making machine wherein cut filler (preferably blended) is air formed into a continuous rod of tobacco on a traveling belt and entrapped with a continuous ribbon of plug wrap 84 which is then glued along its longitudinal seam and heat sealed. In accordance with the preferred embodiment of the present invention, the plug wrap 84 is preferably constructed from a cellulosic web of little or no filler, sizing or burn additives (each at levels below 0.5% weight percent) and preferably little or no sizing. Preferably, the tobacco plug wrap 84 has a low basis weight of below 15 grams per meter squared and more preferably about 13 grams per meter squared. The tobacco plug wrap 84 preferably has a high permeability in the range of about 20,000 to 35,000 CORESTA and more preferably in the range of about 25,000 to 35,000 CORESTA, and is constructed preferably from soft wood fiber pulp, abaca-type cellulose or other long fibered pulp. Such papers are available from Papierfabrik Schoeller and Hoescht GMBH, Postfach 1155, D-76584, Gernsback, GERMANY; another paper suitable for use as the plug wrap 84 is the paper TW 2000 from DeMauduit of Euimperle FRANCE, with the addition of carboxy-methyl cellulose at a 2.5 weight percent level.

The tobacco rod making machine is operated so as to provide a tobacco rod density of approximately 0.17 to 0.30 grams per cubic centimeter (g/cc), but more preferably in a range of at least 0.20 to 0.30 g/cc and most preferably between about 0.24 to 0.28 g/cc. The elevated densities are preferred for the avoidance of loose ends at the free end 78 of the tobacco rod 60. However, it is to be understood that the lower rod densities will allow the tobacco column 82 to contribute a greater proportion of aerosol and flavor to the smoke. Accordingly, a balance must be struck between aerosol delivery (which favors a low rod density in the tobacco column 82) and the avoidance of loose-ends (which favors the elevated ranges of rod densities).

The tobacco column 82 preferably comprises cut filler of a blend of tobaccos typical of the industry, including blends comprising bright, burley and oriental tobaccos together with, optionally, reconstituted tobaccos and other blend components, including traditional cigarette flavors. However, in the preferred embodiment, the cut filler of the tobacco column 84 comprises a blend of bright, burly and oriental tobaccos at the ratio of approximately 45:30:25 for the U.S. market, without inclusion of reconstituted tobaccos or any after cut flavorings. Optionally, an expanded tobacco component might be included in the blend to adjust rod density, and flavors may be added.

The continuous tobacco rod formed as described above is sliced in accordance with a predetermined plug length for the tobacco plug 80. This length is preferably at least 7 mm in order to facilitate machine handling. However, the length may vary from about 7 mm to 25 mm or more depending on preferences in cigarette design which will become apparent in the description which follows, with particular reference to FIG. 7.

As a general matter, the length of the tobacco plug 80 is preferably set relative to the total length of the tobacco rod 60 such that a void 91 is defined along the tobacco rod 60 between the free-flow filter 74 and the tobacco plug 80. The void 91 corresponds to an unfilled portion of the tobacco rod 60 and is in immediate fluid communication with the tipping 62 through the free flow filter 74 of the tobacco rod 60.

Referring particularly to FIG. 6, the length of the tobacco plug 80 and its relative position along the tobacco rod 60 is also selected in relation to features of the heater elements 37. When a cigarette is properly positioned against a stop 182 within the lighter 25, a portion 93 of each heater element 37 will contact the tobacco rod 60 along a region of the tobacco rod 60. This region of contact is referred to as a heater footprint 95. The heater footprint 95 (as shown with a double arrow in FIG. 2) is not part of the cigarette structure itself, but instead is a representation of that region of the tobacco rod 60 where the heater element 37 would be expected to reach operative heating temperatures during smoking of the cigarette 23. Because the heating elements 37 are a fixed distance 96 from the stop 182 of the heater fixture, the heater foot print 95 consistently locates along the tobacco rod 60 at the same predetermined distance 96 from the free end 78 of the tobacco rod 60 for every cigarette 23 that is fully inserted into the lighter 25.

Preferably, the length of the tobacco plug 80, the length of the heater footprint 95 and the distance between the heater footprint 95 and the stop 182 are selected such that the heater footprint 95 extends beyond the tobacco plug 80 and superposes a portion of the void 91 by a distance 98. The distance 98 by which the heater footprint 95 superposes the void 91 (the unfilled portion of the tobacco rod 60) is also referred to as the "heater-void overlap" 98. The distance by which the remainder of the heater footprint 95 superposes the tobacco plug 80 is referred to as the "heater-filler overlap" 99.

The tipping 62 preferably comprises a free-flow filter 92 located adjacent the tobacco rod 60 and a mouthpiece filter plug 94 at the distal end of the tipping 62 from the tobacco rod 60. Preferably the free-flow filter 92 is tubular and transmits air with very little pressure drop. Other low efficiency filters of standard configuration could be used instead, however. The inside diameter for the free flow filter 92 is preferably at or between 2 to 6 millimeters and is preferably greater than that of the free flow filter 74 of the tobacco rod 60.

The mouthpiece filter plug 94 closes off the free end of the tipping 62 for purposes of appearance and, if desired, to effect some filtration, although it is preferred that the mouthpiece filter plug 94 comprise a low efficiency filter of preferably about 15 to 25 percent efficiency.

The free-flow filter 92 and the mouthpiece filter plug 94 are preferably joined together as a combined plug with a plug wrap 101. The plug wrap 101 is preferably a porous, low weight plug wrap as is conventionally available to those in the art of cigarette making. The combined plug is attached to the tobacco rod 60 by the tipping paper 64 of specifications that are standard and conventionally used throughout the cigarette industry. The tipping paper 64 may be either cork, white or any other color as decorative preferences might suggest.

Preferably, a cigarette 23 constructed in accordance with the preferred embodiment has an overall length of approximately 62 mm, of which 30 mm comprises the combined plug of the tipping 62. Accordingly, the tobacco rod 60 is 32 mm long. Preferably, the free-flow filter 74 of the tobacco rod 60 is at least 7 mm long and the void 91 between the free-flow filter 74 and the tobacco plug 80 is preferably at least 7 mm long. In the preferred embodiment, the heater foot print 95 is approximately 12 mm long and located such that it provides a 3 mm heater-void overlap 98, leaving 9 mm of the heater foot print 95 superposing the tobacco plug 80.

It is to be understood that the length of the void 91, the length of the tobacco plug 80, and the distribution of the perforation holes 263 may be adjusted to facilitate manufacturing and more importantly, to adjust the smoking characteristics of the cigarette 23, including adjustments in its taste, draw and delivery. The pattern of holes 263, the length of the void 91 and the amount of heater-filler overlap (and heater-void overlap) may also be manipulated to adjust the immediacy of response, to promote consistency in delivery (on a puff-to-puff basis as well as between cigarettes) and to control condensation of aerosol at or about the heaters.

In the preferred embodiment, the void 91 (the filler-free portion of the tobacco rod 60) extends approximately 7 mm to assure adequate clearance between the heater foot print 95 and the free-flow filter 74. In this way, margin is provided such that the heater foot print 95 does not heat the free-flow filter 74 during smoking. Other lengths are suitable, for instance, if manufacturing tolerances permit, the void 91 might be configured as short as approximately 4 mm or less, or in the other extreme, extended well beyond 7 mm so as establish an elongate filler-free portion along the tobacco rod 60. The preferred range of lengths for the filler-free portion (the void 91) is from approximately 4 mm to 18 mm and more preferably 5 to 12 mm.

Referring to FIG. 7, a preferred method of manufacturing cigarettes 23 in accordance with a preferred embodiment of the present invention may initiate with the production of a plug comprising a multiple of tobacco plugs 80, preferably in a 2-up configuration and enwrapped with the plug wrap 84.

It is to be understood that reference to a 2-up tobacco plug 80 refers to a plug construction such that if it were divided into two pieces, would render two complete tobacco plugs 80 of the preferred cigarette 23. Likewise, a 2-up tipping plug 62, if separated into 2 pieces, would provide a pair of tippings 62, each comprising free-flow filter 92, a mouth piece filter 94 and a plug wrap 84 as described in connection with the partially-filled cigarette 23 of the preferred embodiment. As a further example, a 2-up tobacco rod plug 60, if severed, would render two complete tobacco rods 60.

Referring back to FIG. 7, production of the 2-up tobacco rod plugs 60 initiates with the construction of 2-up tobacco plugs 80 and the establishment of a supply of 12-up free-flow filter plugs 74.

Preferably the tobacco plug 80 is constructed on a conventional cigarette rod making machine 122 (such as a Molins Mark 9 tobacco rod maker) wherein cut filler (preferably blended) is air formed into a continuous rod of tobacco on a traveling belt and enwrapped with a continuous ribbon of plug wrap 84 which is then glued along its longitudinal seam and heat sealed. The output of the tobacco rod maker 122 is then cut at a cutter 124 and delivered by a suitable arrangement 126 to a first hopper 128 of a combining machine such as a Molins double-action plug-tube combiner. The delivery arrangement 126 may include a HCF tray filler or some other equally suitable arrangement to load the first hopper 128 with the 4-up tobacco plugs 80. Other suitable plug delivery systems might be employed such as mass flow conveyors or pneumatic tubes or the like.

Similarly, the 12-up free-flow filter plugs 74 are produced in continuous fashion from a tubular filter rod maker 130, such as with a maker as described in U.S. Pat. No. 3,637,447 to Berger et al, particularly at column 4. The continuous rod of tubular filter material from the rod maker 130 is cut at a cutter 132 into the 12-up free-flow filter plugs 74 and delivered to a second hopper 134 of the Molins double-action plug-tube combiner ("DATPC ") via a suitable delivery arrangement 136 which preferably comprises a HCF tray filler, although other delivery arrangements as previously described might be used instead.

The 12-up free-flow filter plugs 74 from the second hopper 134 are cut into six 2-up free-flow filter plugs 74 and the 4-up tobacco plugs from the first hopper 128 are cut into two 2-up tobacco plugs 80. These 2-up tobacco plugs 80 and 2-up free-flow filter plugs 74 are then placed in alternating relation to one another upon a conveyor 140 leading to a garniture belt 142. Such mechanical action can be provided at the front end of a Molins DAPTC combiner. The spacing between the 2-up tobacco plugs 80 and the 2-up free-flow filter plugs 74 is set to equal the desired amount of void 91 desired in the tobacco rod 60 of the cigarette 23 being produced.

In most Molins DAPTC combiners, this spacing 91 between the 2-up plugs on the conveyor 140 is set precisely with a collator/spacer drum 139 located at or about the location where the compression belt 141 and the garniture belt 142 receive the 2-up free-flow filter plugs 74 and the 2-up tobacco plugs 80. Other suitable arrangements for assuring proper placement of the 2-up plugs 74 and the 2-up tobacco plugs 80 would be readily apparent to one of ordinary skill in the art of combining plugs.

Just upstream of the garniture belt 142, a continuous ribbon of tobacco web 66 is reeled from a bobbin 144 through a series of slack and tension controlling rollers generally designated 146 and past a glue applicator 148 prior to its arrival at the final roller 150, which then directs the ribbon of tobacco web 66 toward the path of the garniture belt 142.

Likewise, a continuous ribbon of overwrap 71 is reeled from a bobbin 152 through an arrangement for adjusting slack and/or tension in the ribbon 71 generally designated 154, past a plurality of glue applicators 156 and then about a final roller 158 which directs the ribbon of overwrap 71 toward the path of the garniture belt 142 and between the garniture belt 142 and the tobacco web 66.

During passage through the garniture 160, the continuous ribbon of tobacco web 66 and the overwrap 71 are folded about the spaced apart 2-up tobacco plugs 80 and the 2-up free-flow filter plugs 74 to produce a continuous rod 162 which is then cut at the cutter head of the DAPTC machine to produce tobacco rod portions 164. The cutter head 166 is arranged to cut every other 2-up tobacco plug 80 so as to produce 2-up tobacco rods 164 having a 1-up tobacco plug 80 at opposite ends thereof and a 2-up free-flow filter 74 separated from the tobacco plugs 80 by spaces 91. The 2-up tobacco rods 164 are delivered from the output of the combining machine to a drum link-up assembly 220 which cuts the 2-up tobacco rods in half to form tobacco rods of unit length and delivers the cut tobacco rods to an assembly drum of the tipping apparatus.

The apparatus according to the invention eliminates the need to load cut tobacco rods into a hopper of a tipping machine and thereby minimizes damage which could occur to the tobacco rods during transport through such a hopper system. For instance, commonly-owned U.S. Pat. No. 5,666,976 discloses an arrangement wherein 4-up tobacco rods are delivered to a tray filler and then to a hopper of a tipping machine wherein the 4-up tobacco rods are transported through a series of drums which effect cutting of the 4-up tobacco rods into 2-up tobacco rods and then into 1-up tobacco rods. Such an arrangement exposes the 4-up tobacco rods to mechanical abrasion which can damage the tobacco rods. The apparatus according to the invention obviates the need for a hopper to receive the tobacco rods since the output of the combining apparatus wherein the tobacco rods are manufactured is directly linked to the tipping machine by the drum link-up assembly.

Figure 9:
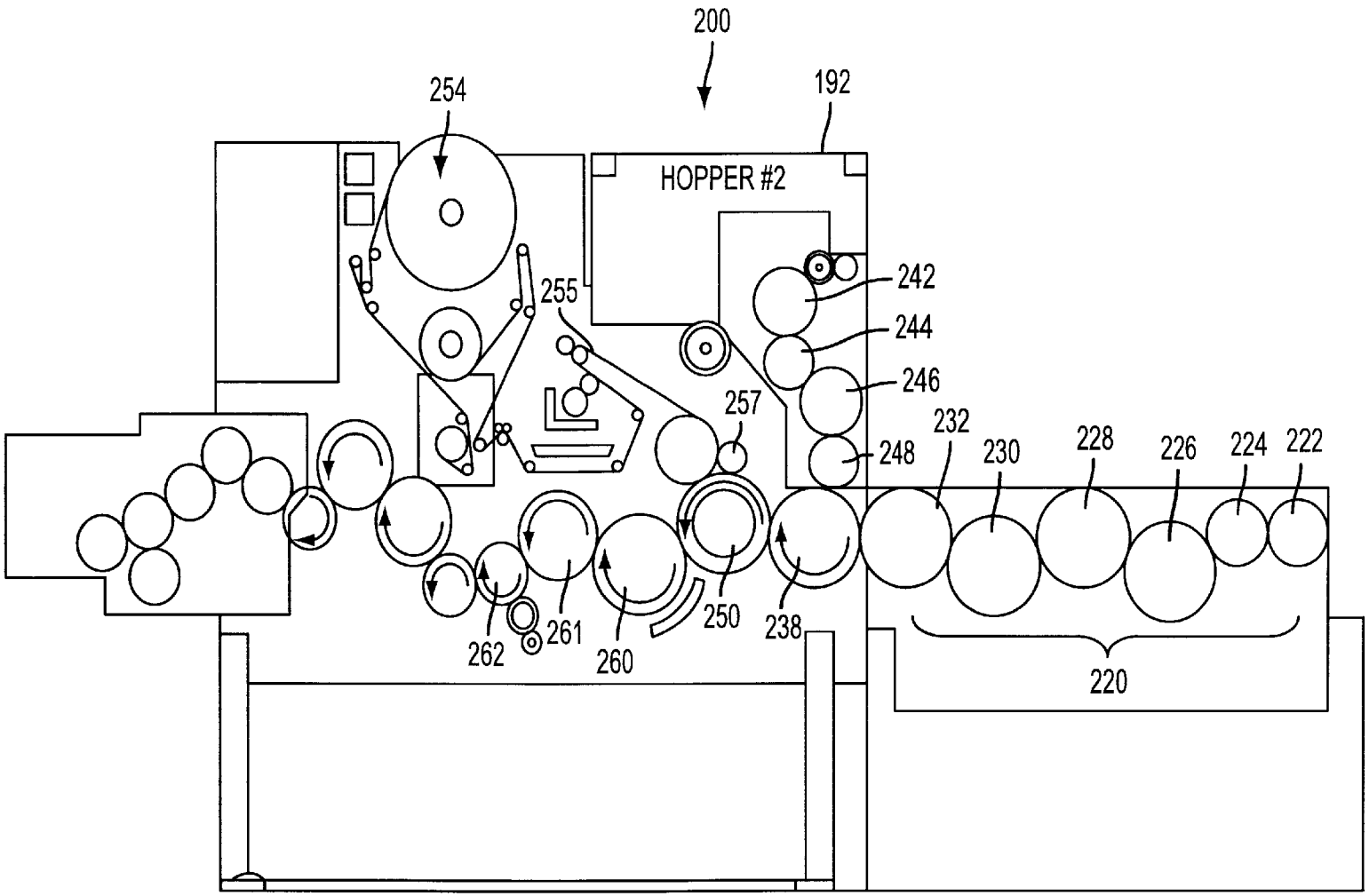
FIG. 9 is a diagram of a tipping apparatus which is adapted to attach filter tipping to the tobacco rod portions produced in accordance with the process in FIG. 7.

The DAPTC machine shown in FIG. 7, is hard-linked to the cigarette tipping machine 200 (shown in FIG. 9) by the drum link-up assembly 220. The drum link-up assembly can be comprised of a plurality of drums in any suitable arrangement. A preferred arrangement which allows optional laser perforation of the tobacco rod is shown in FIG. 9. It should be appreciated that this connection between the DAPTC machine and the tipping machine 200, allows for a smooth transition from the DAPTC to the tipping machine 200 in a quick and efficient manner.

Referring back to the garniture 160 of FIG. 7 and in specific reference to FIGS. 8A–8E, as the various components of the tobacco rod 60 are pulled through the garniture 160, a progression of folding steps wraps the continuous ribbon of tobacco mat 66 and the continuous ribbon of overwrap 71 about the alternating succession of 2-up plugs 80 and 74.

Figure 8A:
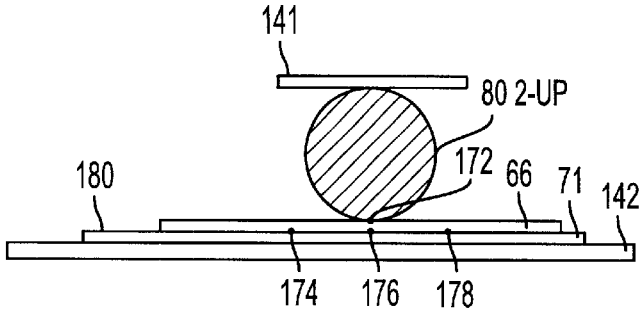
FIGS. 8A–8E are successive cross-sectional views at lines A—A to E—E, respectively at the garniture in FIG. 7, as components of the cigarette shown in FIG. 4 progress through the garniture.

Referring now to FIG. 8A, upon their arrival at the garniture belt 142, the plugs 74 and 80, the tobacco web 66 and the overwrap 71 are urged against one another and the garniture belt 142 by the compression belt 141. A continuous bead of adhesive 172 is located at or about the center region of the continuous ribbon of tobacco web 66 as applied by the glue applicator 148. This bead of adhesive 172 anchors the 2-up tobacco plugs 80 and 2-up free-flow filter plugs 74 to the ribbon of tobacco web 66.

Likewise, a glue applicator can be used to lay down intermittent beads of adhesive or plural glue applicators 156 can be used to lay down continuous beads of adhesive 174, 176 and 178 on the side 180 of the continuous ribbon of overwrap 71 which is to come into contact with the continuous ribbon of tobacco web 66 at the garniture 160. It is preferred that these "laminating" beads of adhesive 174, 176 and 178 are not allowed to set prior to entry into the garniture 160 so the tobacco web 66 and the overwrap 71 may slip slightly relative to one another as they are folded about the 2-up plugs 80 and 74 in the garniture 160. This provision for at least some "give" avoids breaks and tears in the materials.

Figure 8B:
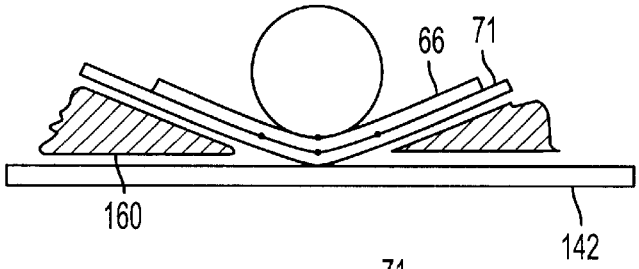
Figure 8C:
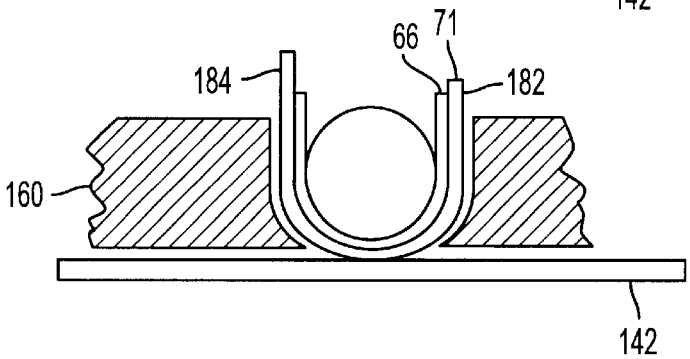
Figure 8D:
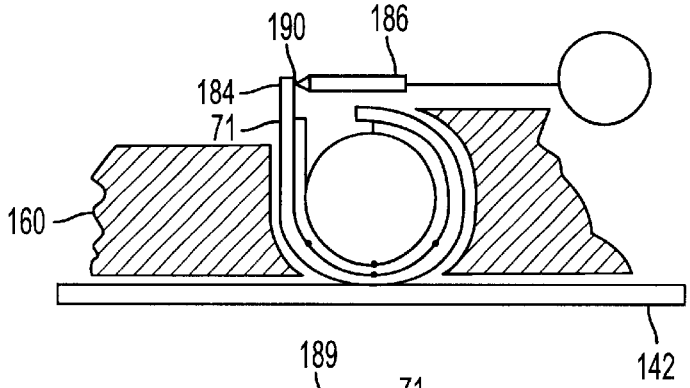
Figure 8E:
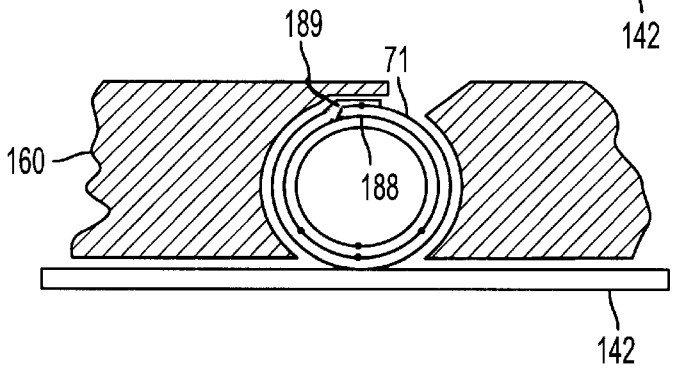

Referring now to FIGS. 8B and 5C, the garniture 160 progressively folds the continuous ribbon of tobacco web 66, together with the continuous ribbon of overwrap 71 about the 2-up plugs 74 and 80. It is to be noted that the relative placements of the tobacco web 66 and the overwrap 71 are slightly offset from one another so that along one side of the plugs 74 and 80 an edge portion 182 of the overwrap 71 extends only slightly beyond the adjacent edge of the tobacco mat 66, preferably at about 1 millimeter or so, whereas along an opposite side of the plugs 74 and 80, an edge portion 384 of the overwrap 71 extends at least several millimeters beyond the adjacent edge of the tobacco web 66. Such provision allows for the application of a bead of adhesive along the edge portion 184 by a glue applicator 186 as shown in FIG. 8D, prior to the edge portion 184 being folded completely down and over the plugs 74 and 80 as shown in FIG. 8E to form a seam 189.

It is to be noted that the tobacco web 66 is folded such and its width is selected such that it does not overlap upon itself at its seam 188. Preferably, no adhesive is applied at or about the seam 188 of the tobacco web 66 so as to minimize the application of adhesive to the structure of the tobacco rod structure 60.

It has also been found effective to locate the laminating adhesive beads 174, 176 and 178 at 4 o'clock, 6 o'clock and 8 o'clock positions relative to the cross-sectional form of the 2-up plugs 74 and 80 at the garniture 160.

The preferred adhesive for all adhesive beads 174, 176, 178, 172 and 190 is a liquid starch adhesive such as obtainable from National Starch. The bead of adhesive 190 is sufficiently strong enough to retain the tobacco web 66 in its completely folded condition.

According to a preferred embodiment, the output of the combining apparatus is a 2-up tobacco rod plug 164 which is directly linked to a catch drum 222 of the drum link-up assembly 220 at the entrance to a cigarette tipping machine 200 such as a Hauni Max that has been modified to operate in the manner as described with reference to FIGS. 10A and 10B. A preferred layout of the modified Hauni Max is shown in FIG. 9. However, other tipping machines or the like could be arranged to execute the steps of cigarette manufacture that are described below.

Figure 10A:
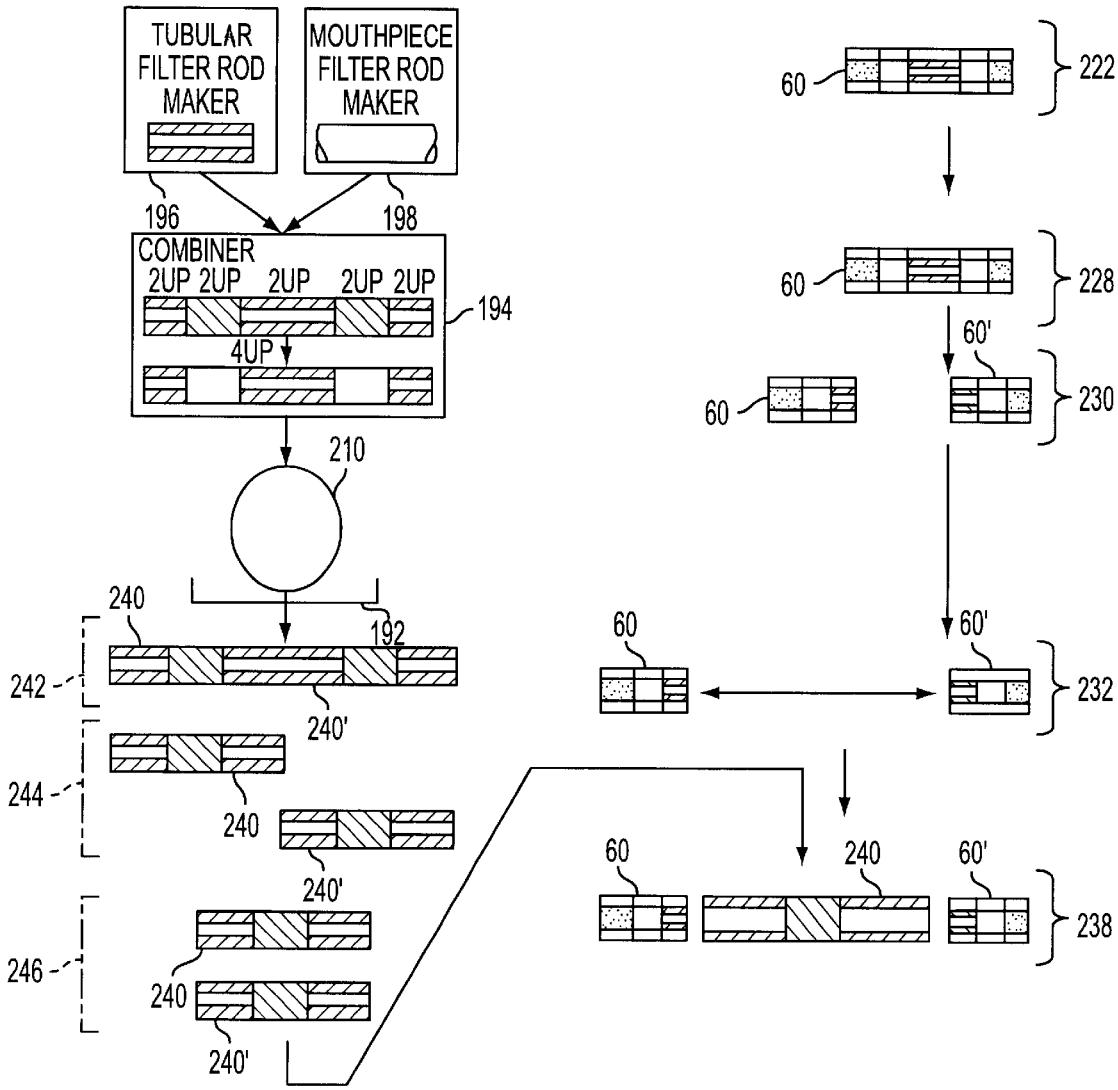
FIGS. 10A and 10B are diagrams showing the relative movement and placement of cigarette pieces during execution of the tipping operation of the preferred method of manufacturing cigarettes of the type shown in FIG. 4.
Figure 10B:
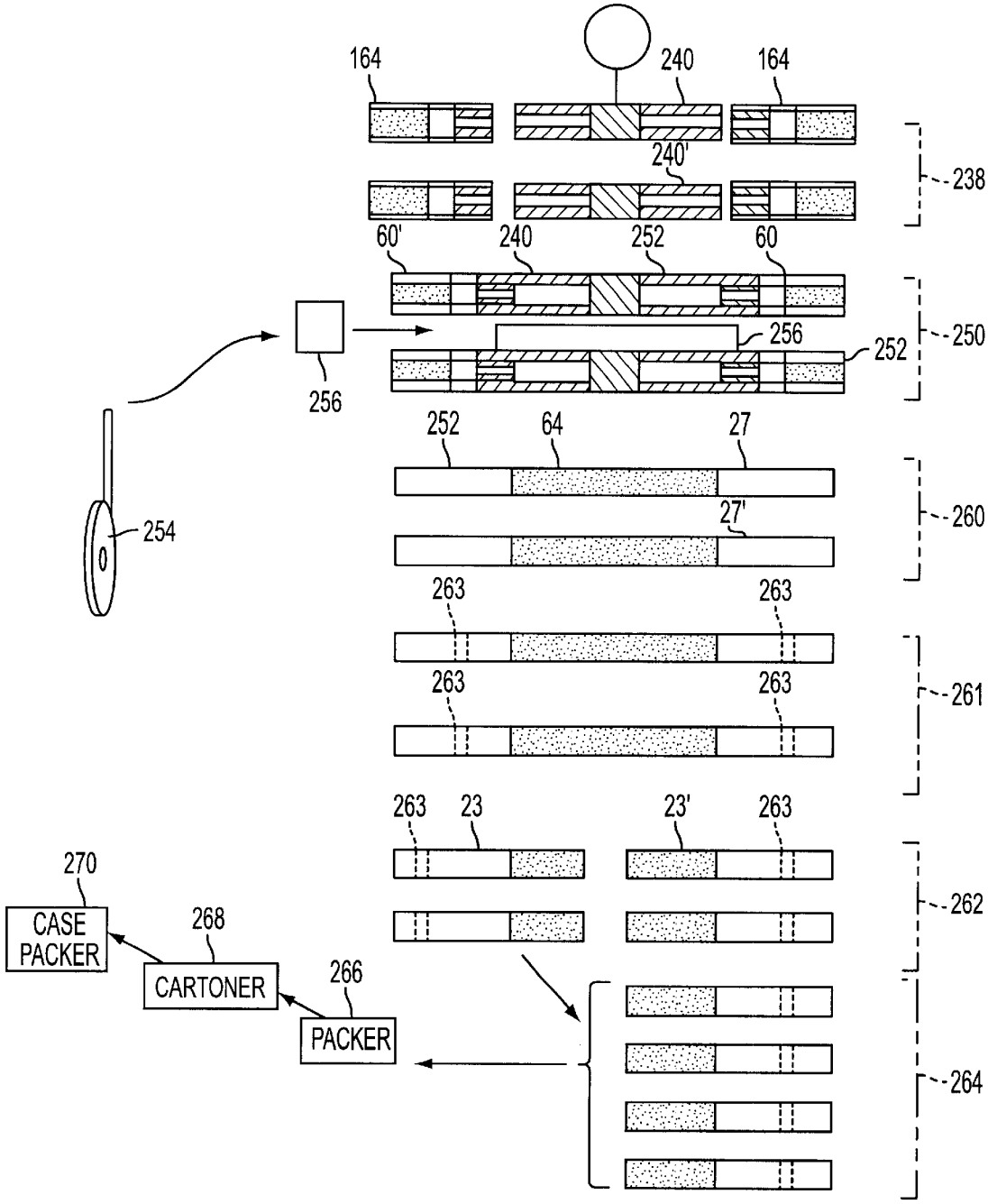

Referring now to FIGS. 9 and 10A–10B, a hopper 192 of the tipping machine 200 receives 4-up tipping plugs 62 which are the product of a combining operation 194 (FIG. 10A), wherein 2-up free-flow filter plugs 92 from a tubular filter rod maker 196 and 2-up mouthpiece filter plugs 94 from another filter rod maker 198, such as a KDF-2, are combined, together with plug wrap 84, to produce the aforementioned 4-up tipping plugs 62 (a plug which when severed into four pieces provides four tippings 62, each comprising a free-flow filter 92, a mouthpiece filter 94 and plug wrap 84). The 4-up tipping plugs 62 are delivered to the hopper 192 of the tipping machine 200 by suitable delivery arrangement.

The description of further steps in the preferred method of producing the cigarettes 23 will now be described with reference to the relative movement and position of the cigarette components as shown in FIGS. 10A–10B, with cross-reference to respective drum stations along the mechanical pathway of the machine 200 as shown in FIG. 9. FIGS. 10A–10B include dashed lines that bear designations which correlate to drums in the machine 200 of the same designation.

The 2-up tobacco rod portions 164 are transferred directly from the combining apparatus to the drum link-up assembly 220. In the embodiment shown in FIG. 9, the 2-up tobacco rods are transferred to a catch drum 222 of the drum link-up assembly. The drums of the drum link-up assembly include flutes for receiving tobacco rods and vacuum arrangements which apply vacuum to the flutes at rotational positions of the drums where it is desired to hold the tobacco rods via suction. The vacuum is terminated at rotational positions of the drum where it is desired to release the tobacco rods for transfer to an adjacent drum. To facilitate transfer of the tobacco rods from one drum to another, the drums rotate in opposite directions, i.e., a tobacco rod traveling in a clockwise direction on one drum is picked up by an adjacent drum rotating in a counterclockwise direction after which the tobacco rod is picked up by a drum rotating in a clockwise direction and so on.

As shown in FIG. 9, the next member to receive the tobacco rods 60 from the catch drum 222 is a transfer drum 224 which transfers the tobacco rods onto the next component. The main purpose of the transfer drum 224 is to properly orient the tobacco rods 164 to be transferred to the next component. Another purpose of the transfer drum is to allow the tobacco rods to be properly passed so a desired delivery of the tobacco rods may be achieved due to the rotation of the various drums. For example, the drum 232 in FIG. 9 currently is rotating in a counterclockwise direction.

Next, the tobacco rods are transferred to a swash-plate drum 226. The main purpose of the swash-plate drum 226 is to center the tobacco rods, and to properly align the tobacco rods, before the tobacco rods are transferred to the next component.

Subsequently, the tobacco rods are transferred to a laser drum 228 which can be used to form perforations on the tobacco rods. The laser drum 228 may be set up as needed by the user to create perforations either circumferentially or longitudinally, but in the preferred method the perforations are positioned circumferentially. Any type of laser system may be used that can accomplish the objective of creating perforations. However, the perforations can be omitted or formed by another suitable technique.

After passing around the laser drum 228, the tobacco rods are transferred to a cutting drum 230, wherein the tobacco rods are cut by a cutter (not shown). In the preferred apparatus, the tobacco rods are cut by a cutter which is rotating in a direction opposite to that of the cutting drum 230. Preferably, the cutter cuts the tobacco rods in half from a 2-up 64 mm tobacco rod to two 32 mm tobacco rods 60, 60'.

After the tobacco rods 60, 60' are cut, to a length desired by the user, the tobacco rods 60, 60' are transferred to a separator drum 232. The primary purpose of the separator drum 232 is to separate the two tobacco rods 60, 60' to create a space between the two tobacco rods 60, 60' so that a 2-up tipping plug 62 may be placed in between the two tobacco rods 60, 60'.

The tipping plugs are combined with the tobacco plugs as follows. First, 4-up tipping plugs 62 from the hopper 192 are delivered onto a third cutting drum 242 and cut into two, 2-up tipping plugs 240 and 240'. Each 2-up tipping plug 240 comprises a 1-up free-flow filter 92 at one end, a centrally located 2-up mouthpiece filter 94 and another 1-up free-flow filter 92 at the other end of the 2-up tipping plug 240.

The 2 two-up tipping plugs 240 and 240' are then graded at a grading drum 244 and aligned on a alignment drum 246. The aligned two-up tipping plugs 240 and 240' are then transferred through an accelerator drum 248 onto a central portion of the assembly drum 238 so as to locate the 2-up tipping plugs 240 and 240' centrally between the pairs of separated tobacco plugs 60, 60'. At the conclusion of this operation, on each flute of the assembly drum 238, the free ends of the free-flow filters 92 of a 2-up tipping plug face the free-flow filters 74 of a separated pair of tobacco rods 60'.

Next, the aforementioned components placed at the assembly drum 238 are transferred to a swash-plate drum 250 whose outer rail pushes the associated pairs of tobacco rods 60, 60' into abutting relationship with the respective 2-up tipping plug 240 situated therebetween. Meanwhile, a continuous ribbon of tipping paper is drawn from a bobbin 254 and directed through a glue applicator 255 and severed into double-wide pieces 256 at a cutter 257. Once the cigarette components are positioned by the swash plate, an edge-portion of a double-wide piece of tipping paper 64 is attached to the respective 2-up tipping plug 240 and abutting portions of the pair of tobacco rods 60, 60' so as to initiate connection of these components to form 2-up cigarette rods 252. The tipping operation is then continued on a roll drum 260 which rolls the double-wide pieces of tipping paper 256 about the 2-up cigarette rods 252. The 2-up cigarette rods 252 are then transferred to drum 261, wherein a plurality of perforations are optionally created on the 2-up cigarette rods 252. In the preferred embodiment, the perforations 263 are created by a laser system. The perforations 263 are oriented circumferentially around the cigarette rods 252, and are preferably located anywhere from 4 mm to 20 mm, e.g. 4 to 12 mm from the free end 15 of the cigarette such that the perforations extend into the tobacco plugs 80. The rods 252 are then cut in two at a final cut drum 262 to produce a pair of cigarettes 23 and 23' from each of the rods 252. At a turning drum 264, one of the cigarettes 23 is turned and aligned with the other cigarette 23'.

The continuous stream of cigarettes 23 produced from the tipping machine 200 is then directed to packers 266 and cartoners 268 and finally case packers 270 for shipment from the manufacturing facilities.

Figure 11:
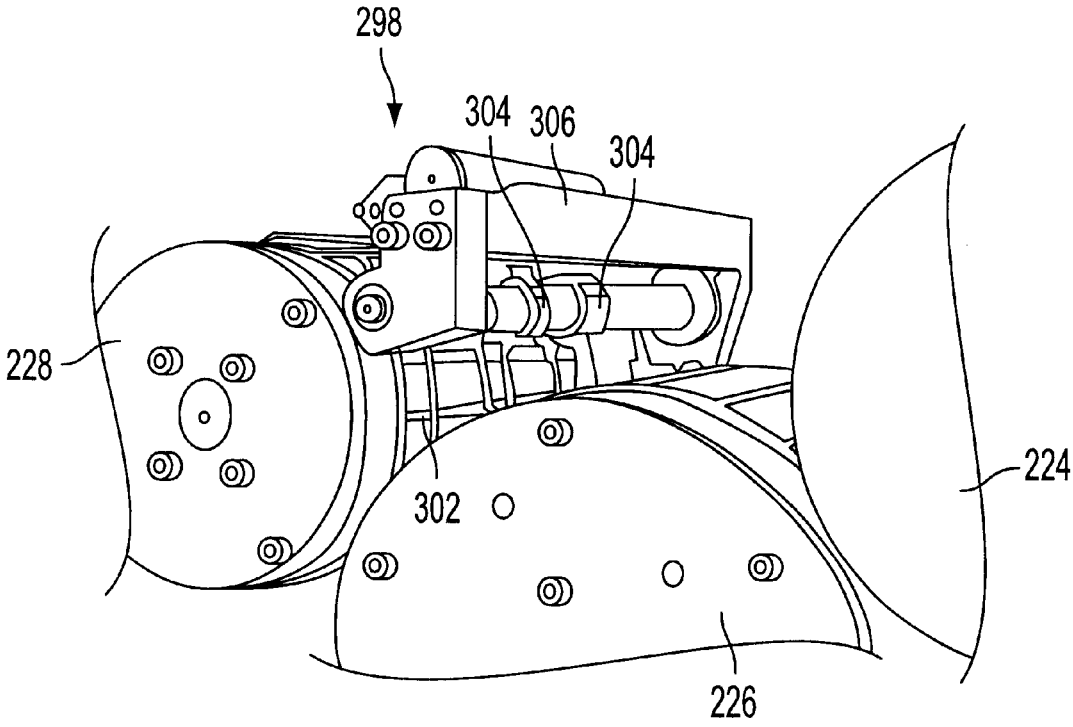
FIG. 11 shows a perspective side view of a laser perforating apparatus which can be used to burn perforation holes in tobacco rods in accordance with the invention.

It will be understood that any type of perforating system can be used to perforate the tobacco rods prior to being attached to the filter rods and/or after the tobacco rods are attached to the filter rods. A preferred perforating system is a laser perforating system, many forms of which are available commercially. FIG. 11 shows a perspective side view of portions of a Hauni 500 laser perforating system which is commercially available from Hauni Maschinenbau AG, located in Hamburg, Germany. According to the invention, the laser system can be used to burn perforation holes in tobacco rods at a location in the drum link-up assembly 220 located between a combining apparatus and a tipping apparatus. In addition, another Hauni 500 laser system can be used to burn perforation holes in a tobacco rod of a completed cigarette at a location near the exit of the tipping apparatus.

As shown in FIG. 11, the laser perforating apparatus 298 includes the laser perforating drum 228, flutes 302 for holding tobacco rods (or completed cigarettes in the case where the laser perforating apparatus is located in the tipping apparatus), rolling cams 304 which engage the rods/cigarettes located in the flutes 304 so as to roll the rods/cigarettes from a first portion of the flute to a second portion of the flute (see FIG. 13), and a laser beam directing device 306 which splits a laser beam into two beams for perforating two locations on the tobacco rods/cigarettes. The preferred location for burning the perforating holes in the 2-up tobacco rods passing through the drum link-up apparatus 220 (or in the tobacco rods of the completed cigarettes) is with an area located 4 to 20 mm from the end of the tobacco rod at which the tobacco plug 80 is located. With reference to FIG. 6, the perforating holes 263 thus formed will pass through the tobacco rod outer overwrap 71, the tobacco mat 66, the overwrap 84 surrounding the tobacco plug 80 and into the tobacco plug 80.

Figure 12:
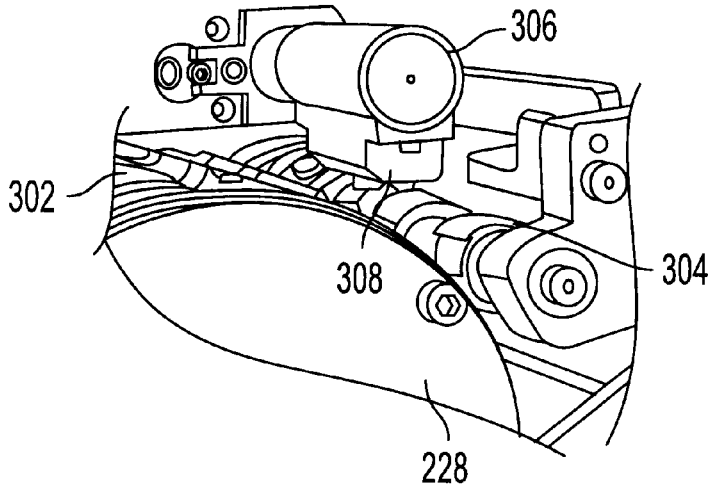
FIG. 12 is a perspective view of the apparatus shown in FIG. 11 but from an opposite side thereof.
Figure 13:
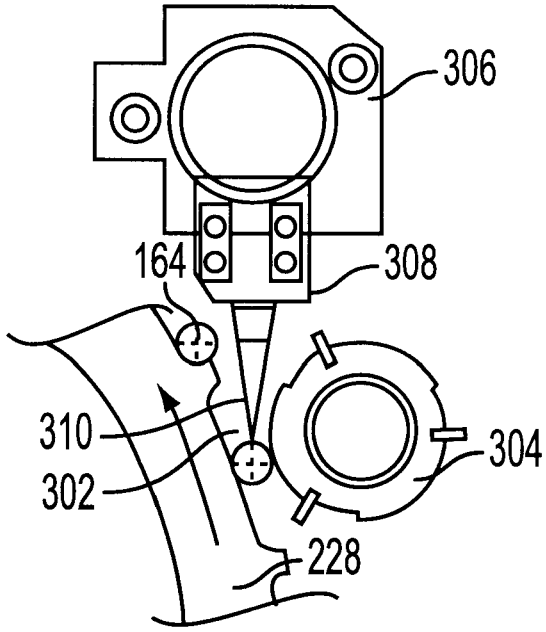
FIG. 13 is a cross sectional view of a portion of the apparatus shown in FIG. 11.
Figure 14:
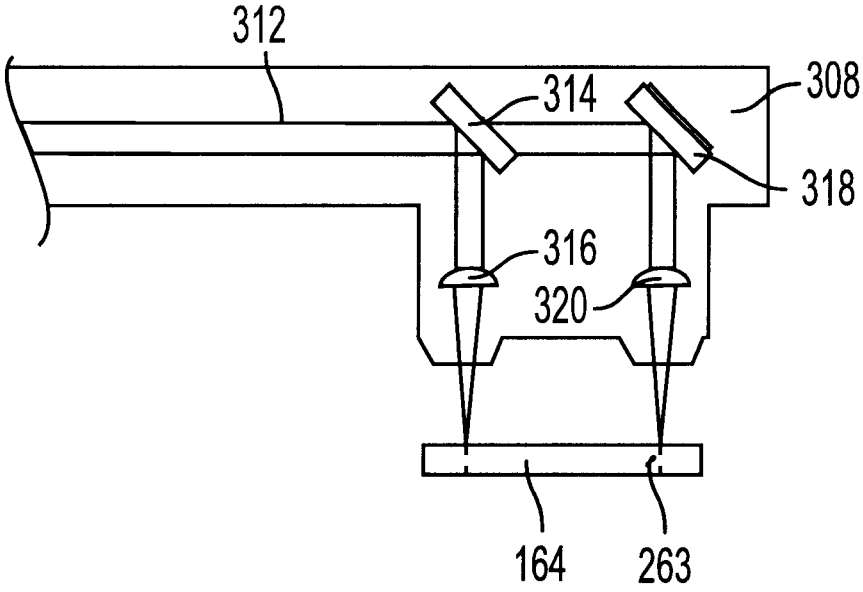
FIG. 14 is a cross sectional view of a beam splitting arrangement which can be used in the apparatus shown in FIG. 1.

FIG. 12 is a perspective view of the apparatus shown in FIG. 11 but from an opposite side thereof. As shown in FIG. 12, the laser beam directing device 306 includes a focusing device 308 wherein a plurality of beams are focused on an individual tobacco rod 164. Further details of the focus device 308 can be seen in FIGS. 13 and 14. As shown in FIG. 13, the focusing device directs a focused laser beam 310 onto the tobacco rod 164 as the tobacco rod is rotated about its axis along the surface of the flute 302 by the rolling cam 304. The laser (not shown) is actuated by a controller (not shown) which is programmed to deliver a pulsed beam during rotation of the tobacco rod in the flute after which the beam is shut off until the next tobacco rod is in a location suitable for perforation by the beam. FIG. 14 shows a beam 312 from the laser (not shown), a first mirror 314 for deflecting a portion of the beam 312 to a first lens 316, and a second mirror 318 for deflecting a second portion of the beam 312 to a second lens 320. As a result, the beam splitter arrangement shown in FIG. 14 directs a pair of beams onto the 2-up tobacco rod 164 at locations near the free ends thereof.

The laser system can be set up to provide any desired perforation hole pattern in the tobacco rods. According to a preferred embodiment, the laser is programmed to burn 12 to 24 holes having a width of about 0.06 mm into the outer surface of each tobacco rod. The holes can be provided in a single row or multiple rows extending around the circumference of the tobacco rod and depending on the length of the laser pulse width (the amount of time the laser is in the "on" portion of a pulse cycle), the length of the holes in the circumferential direction can vary accordingly. Further, the row or rows can be provided at longitudinally spaced apart locations along the tobacco rod. For example, a row of perforations could be provided at a location about 4 mm from the end of the tobacco rod and another row of perforations could be provided at a location about 7 to 12 mm from the end. Moreover, by focusing the beam such that the focal point is inside the tobacco rod, a pair of adjacent holes can be burned into the tobacco rod during each pulse of the laser, i.e., a single beam focused in this way can provide a double row of perforations extending around the tobacco rod.

In terms of operational parameters, the laser system should be capable of penetrating the outer layers of the tobacco rod and provide a desired pattern of holes while the tobacco rods travel through the drum link-up assembly at speeds capable of producing over 4000 rods/cigarettes per minute. As an example, a 300 watt laser having a pulse duration of 1000 $\mu$s can be operated with a pulse width of 200 to 400 $\mu$s (the amount of time the laser is "on" during the pulse duration) to obtain a single or double row of perforations in a 2-up tobacco rod traveling through the drum link-up assembly at a speed sufficient to produce 5000 cigarettes per minute. In such a system, a double row of 24 perforations with 12 perforations in each row can be obtained using a pulse width of 400 $\mu$s. However, the actual power settings used will depend on the particular laser system and the set-up associated therewith.

Figure 15:
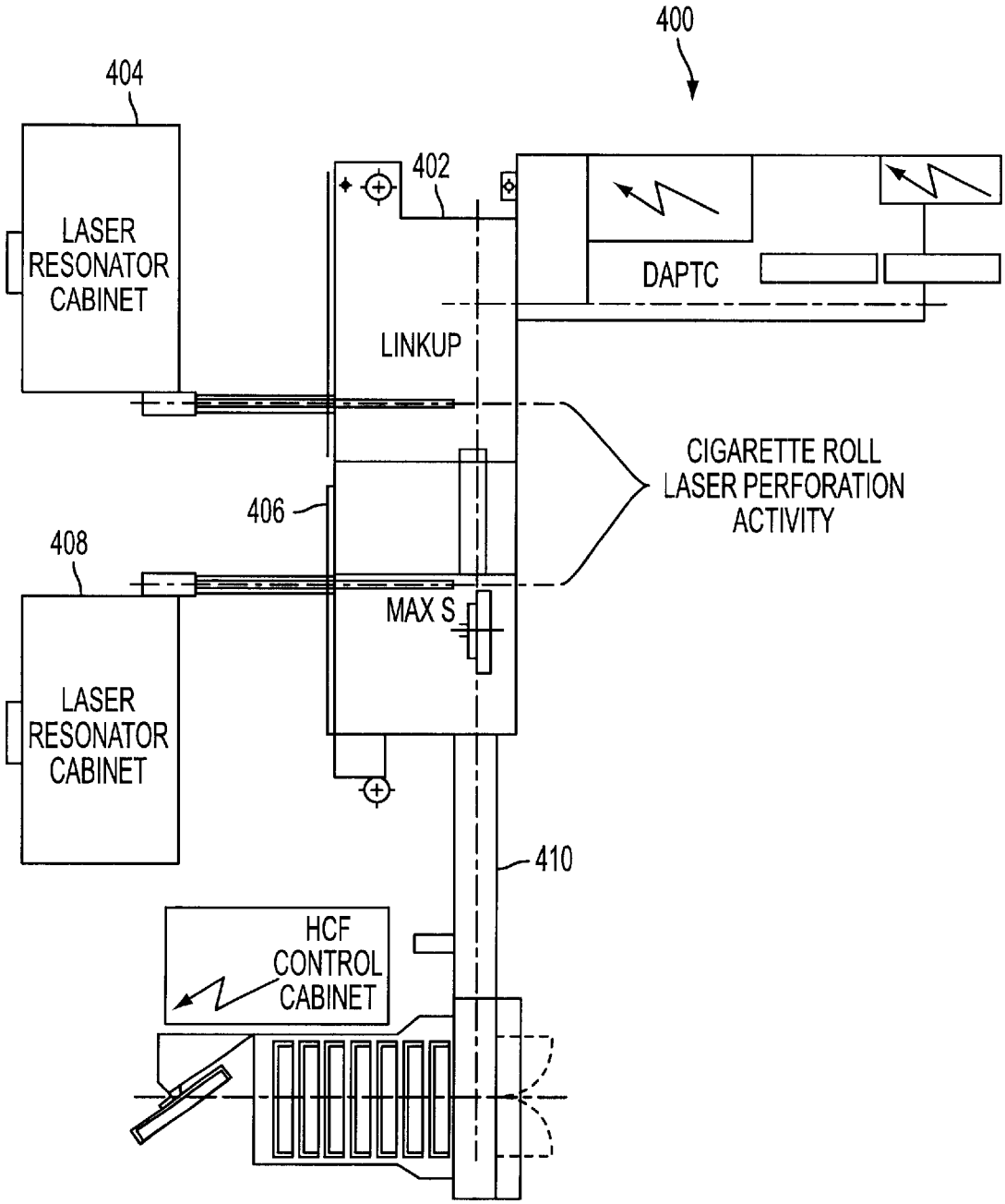
FIG. 15 is a schematic diagram showing a combining apparatus directly linked to a tipping apparatus by a transfer apparatus in accordance with the invention.

FIG. 15 shows a schematic layout of a combining apparatus (DAPTC) 400, a link-up 402, a first laser perforating station 404, a tipping apparatus (MAX S) 406, a second laser perforating station 408, and a conveying apparatus 410 for transporting, loading and packaging the finished cigarettes. As shown, the DAPTC 400 conveys tobacco rods in a direction perpendicular to the direction in which the tobacco rods are attached to filter rods in the tipping apparatus.

It is to be understood that the present invention may be embodied in other specific forms and process the use without departing from the spirit or essential characteristics of the present invention. For example, the cutting and slitting operations may be reconfigured to cut different multiples of plugs. Although the disclosure specifies certain machines as being preferred, one of ordinary skill in the art, once familiar with these teachings, would be able to select other machines for executing the disclosed process. Additionally, certain plug structures might be altered such as replacing tubular plugs with those that may have a filled central portion. Thus, while the invention has been illustrated and described in accordance with various preferred embodiments, it is recognized that variations and changes may be made therein without departing from the invention as set forth in the claims.

What is claimed is:

1. An electrical smoking system comprising:

a cigarette comprising a tubular tobacco mat partially filled with tobacco material so as to define a filled tobacco rod portion and an unfilled tobacco rod portion, said filled tobacco rod portion being adjacent a free end of said cigarette; and a lighter comprising an electrical heater element and a system for electrically actuating said heater element, said lighter arranged to at least partially receive said cigarette;

said cigarette and said lighter being mutually arranged so that when the cigarette is received in said lighter, said electrical heater element of the lighter at least partially superposes at least a portion of the filled tobacco rod portion;

said cigarette and said lighter being mutually arranged so that when the cigarette is received in said lighter, said free end of said cigarette is occluded;

said cigarette including a zone of perforations at a first location along said filled tobacco rod portion;

said cigarette being free of perforations along said unfilled tobacco rod portion.

2. The electrical smoking system as claimed in claim 1, wherein said lighter further comprises an air admission passage and an arrangement operative at a location along said air admission passage to produce a pressure drop in the range of 10 to 40 mm water.

3. The electrical smoking system as claimed in claim 2, wherein said lighter further comprises a puff sensor having a sensitivity to a change in pressure in the range of 10 to 40 mm water.

4. The system as claimed in claim 1, said lighter further comprising an air admission passage and an arrangement operative at a location along said air admission passage to produce a pressure drop in the range of 20 to 30 mm water.

5. The system as claimed in claim 4, said lighter further comprising a puff sensor having a sensitivity to a change in pressure in the range of 20 to 30 mm water.

6. The system as claimed in claim 5, wherein said cigarette has a resistance to draw of approximately 20 to 25 mm water.

7. The system as claimed in claim 4, wherein said lighter further comprises an air flow deflector arranged to direct air drawn into said lighter toward a cigarette receiving location within said lighter, the air flow deflector directing the air in a circumferential zone around the cigarette at the location of the zone of perforations.

8. The system as claimed in claim 7, wherein at least a portion of said lighter adjacent said cigarette receiving location is constructed of a metal, including at least said air flow deflector.

9. The system as claimed in claim 1, wherein said lighter further comprises a flow deflector arranged to direct air drawn into said lighter toward a cigarette receiving location within said lighter, the air flow deflector directing the air in a circumferential zone around the cigarette at the location of the zone of perforations.

10. The system as claimed in claim 9, wherein at least a portion of said lighter adjacent said cigarette receiving location is constructed of a metal, including at least said air flow deflector.

11. A cigarette of an electrical smoking system, comprising a tobacco rod and a filter tipping attached to a tipped end portion of said tobacco rod, said tobacco rod comprising:

a tubular tobacco mat partially filled with tobacco material so as to define a filled tobacco rod portion and an unfilled tobacco rod portion, said filled tobacco rod portion being adjacent a free end of said cigarette;

said cigarette including a zone of perforations at a first location along said filled tobacco rod portion;

said cigarette being free of perforations along said unfilled tobacco rod portion.

12. The cigarette as claimed in claim 11, said tobacco rod further comprising a cigarette wrapper disposed about said tubular tobacco mat, said perforations extending at least partially through said wrapper and said mat.

13. The cigarette as claimed in claim 12, wherein said cigarette is adapted to receive thermal treatment along a length portion of said tobacco rod corresponding to a heater footprint of an electrical lighter, said length portion spaced a predetermined distance from said free end portion of said tobacco rod, said first location of said zone of perforations being spaced from said free end of said tobacco rod a first distance approximately equal to said predetermined distance.

14. The cigarette as claimed in claim 12, wherein said cigarette is adapted to receive thermal treatment along a length portion of said tobacco rod corresponding to a heater footprint of an electrical lighter, said length portion spaced a predetermined distance from said free end portion of said tobacco rod, said first location of said zone of perforations being spaced from said free end of said tobacco rod a first distance greater than said predetermined distance.

15. The cigarette as claimed in claim 12, wherein said cigarette is adapted to receive thermal treatment along a length portion of said tobacco rod corresponding to a heater footprint of an electrical lighter, said length portion spaced a predetermined distance from said free end portion of said tobacco rod, said first location of said zone of perforations being spaced from said free end of said tobacco rod a first distance less than said predetermined distance.

16. The cigarette as claimed in claim 12, further comprising a plurality of circumferentially spaced-apart holes in said tubular tobacco mat at a second location along said filled tobacco rod portion, said wrapper covering said mat holes.

17. The cigarette as claimed in claim 16, wherein said tubular tobacco mat comprises a tubular base web and a layer of tobacco material disposed along an interior of said tubular base web;

said mat holes extending through said base web and said layer of tobacco material.

18. The cigarette as claimed in claim 16, wherein said mat holes are approximately 1 mm in diameter and 6 in number, arranged in a row and said zone of perforations comprises one or two rows of perf-holes, each row having 12 perf-holes.

19. The cigarette as claimed in claim 16, wherein said second location of mat holes is spaced from said free end of said tobacco rod a second distance of approximately 7 mm and said zone of perforations comprises at least one row of 12 perf-holes spaced approximately 12 mm from said free end.

20. The cigarette as claimed in claim 16, wherein a second perforation zone is established at a third location along said tobacco rod;

said second location of mat holes being between said first and third locations, said second location of mat holes is optionally spaced from said free end of said tobacco rod a first distance of approximately 7 mm and said perforation zones are optionally spaced from said free end of said tobacco rod approximately 4 and 12 mm, respectively.

21. The cigarette as claimed in claim 11, said tobacco rod further comprising a cigarette wrapper disposed about said tubular tobacco mat, said perforations extending at least partially through said wrapper and said mat.

22. The cigarette as claimed in claim 21, wherein said cigarette is adapted to receive thermal treatment along a length portion of said tobacco rod corresponding to a heater footprint of an electrical lighter, said length portion spaced a predetermined distance from said free end portion of said tobacco rod, said first location of said zone of perforations being spaced from said free end of said tobacco rod a first distance approximately equal to said predetermined distance.

23. The cigarette as claimed in claim 21, wherein said cigarette is adapted to receive thermal treatment along a length portion of said tobacco rod corresponding to a heater footprint of an electrical lighter, said length portion spaced a predetermined distance from said free end portion of said tobacco rod, said first location of said zone of perforations being spaced from said free end of said tobacco rod a first distance greater than said predetermined distance.

24. The cigarette as claimed in claim 21, wherein said cigarette is adapted to receive thermal treatment along a length portion of said tobacco rod corresponding to a heater footprint of an electrical lighter, said length portion spaced a predetermined distance from said free end portion of said tobacco rod, said first location of said zone of perforations being spaced from said free end of said tobacco rod a first distance less than said predetermined distance.

25. The cigarette as claimed in claim 21, wherein a second perforation zone is established at a third location along said tobacco rod;

a second location of mat holes in said tubular tobacco mat being between said first and third locations, said second location of mat holes is optionally spaced from said free end of said tobacco rod a first distance of approximately 7 mm and said perforation zones are optionally spaced from said free end of said tobacco rod approximately 4 and 12 mm, respectively.

26. The cigarette as claimed in claim 11, wherein said tobacco rod includes a tubular body at the tipped end portion of the tobacco rod; and said filter tipping includes a free flow filter adjacent said tubular body and a mouthpiece filter adjacent said free flow filter.

27. The cigarette as claimed in claim 26, wherein said tubular body has a smaller inside diameter than said free flow filter.

* * * * *